US008556098B2

(12) United States Patent
Peykoff et al.

(10) Patent No.: US 8,556,098 B2
(45) Date of Patent: Oct. 15, 2013

(54) PLASTIC CONTAINER HAVING SIDEWALL RIBS WITH VARYING DEPTH

(71) Applicant: Niagara Bottling, LLC, Ontario, CA (US)

(72) Inventors: Andrew Dimitri Peykoff, Newport Coast, CA (US); Jay Clarke Hanan, Glendora, CA (US)

(73) Assignee: Niagara Bottling, LLC, Ontario, CA (US)

( * ) Notice: Subject to any disclaimer, the term of this patent is extended or adjusted under 35 U.S.C. 154(b) by 0 days.

(21) Appl. No.: 13/705,040

(22) Filed: Dec. 4, 2012

(65) Prior Publication Data

US 2013/0140264 A1 Jun. 6, 2013

Related U.S. Application Data

(60) Provisional application No. 61/567,086, filed on Dec. 5, 2011.

(51) Int. Cl.
*B65D 90/02* (2006.01)
*B65D 8/12* (2006.01)

(52) U.S. Cl.
USPC ..... 215/384; 215/381; 220/670; 220/675

(58) Field of Classification Search
USPC ..... 215/381–384; 220/669–675
See application file for complete search history.

(56) References Cited

U.S. PATENT DOCUMENTS

| | | | | |
|---|---|---|---|---|
| 3,029,963 | A * | 4/1962 | Evers | 215/373 |
| 3,438,578 | A * | 4/1969 | Moyer et al. | 239/33 |
| 4,316,551 | A * | 2/1982 | Belokin, Jr. | 220/667 |
| 4,374,878 | A | 2/1983 | Jakobsen et al. | |
| D294,462 | S | 3/1988 | Ota et al. | |
| 4,756,439 | A * | 7/1988 | Perock | 68/233 |
| 4,818,575 | A | 4/1989 | Hirata et al. | |

(Continued)

FOREIGN PATENT DOCUMENTS

| | | |
|---|---|---|
| FR | 2 846 946 | 5/2004 |
| FR | 2899204 | 10/2007 |

(Continued)

OTHER PUBLICATIONS

International Search Report and Written Opinion for PCT/US2011/060587 dated Mar. 14, 2012 in 12 pages.

(Continued)

*Primary Examiner* — J. Gregory Pickett
*Assistant Examiner* — Ned A Walker
(74) *Attorney, Agent, or Firm* — Knobbe, Martens, Olson & Bear, LLP

(57) ABSTRACT

A bottle may have varying depth ribs to achieve a balance of strength and rigidity while maintaining hoop strength. The varying depth ribs may smoothly transition around the circumference of the bottle from a flattened and/or shallow depth rib portion to a deep rib portion. A collection of flattened and/or shallow depth ribs act as recessed columns in the body of the bottle to resist bending, leaning, crumbling, and/or stretching. The deep rib portions provide hoop strength and make the bottle body more rigid and/or stiffer when gripped by a user. A balance may be achieved between of flattened and/or shallow depth ribs and deep ribs to attain a desired resistance to bending, leaning, and/or stretching while maintaining stiffness in a lightweight bottle.

20 Claims, 16 Drawing Sheets

(56) References Cited

U.S. PATENT DOCUMENTS 4,847,129 A 7/1989 Collette et al.
4,863,046 A 9/1989 Collette et al.
4,907,709 A 3/1990 Abe et al.
D315,869 S 4/1991 Collette
D321,830 S 11/1991 York et al.
5,092,475 A 3/1992 Krishnakumar et al.
5,133,468 A 7/1992 Brunson et al.
5,178,289 A * 1/1993 Krishnakumar et al. ..... 215/382
5,199,588 A 4/1993 Hayashi
5,255,889 A 10/1993 Collette et al.
5,279,433 A 1/1994 Krishnakumar et al.
5,281,387 A * 1/1994 Collette et al. ..... 264/521
D345,693 S 4/1994 Edstrom
5,303,833 A 4/1994 Hayashi et al.
5,303,834 A 4/1994 Krishnakumar et al.
5,337,909 A 8/1994 Vailliencourt
5,341,946 A 8/1994 Vailliencourt et al.
D352,238 S 11/1994 Vailliencourt et al.
D352,245 S 11/1994 Krishnakumar et al.
5,381,910 A * 1/1995 Sugiura et al. ..... 215/398
5,407,086 A 4/1995 Ota et al.
D358,766 S 5/1995 Vailliencourt et al.
5,411,699 A 5/1995 Collette et al.
D364,565 S 11/1995 Vailliencourt et al.
D366,416 S 1/1996 Semersky
D366,417 S 1/1996 Semersky
5,632,397 A * 5/1997 Fandeux et al. ..... 215/382
5,669,520 A * 9/1997 Simpson ..... 215/11.1
5,704,503 A 1/1998 Krishnakumar et al.
D391,168 S 2/1998 Ogg
D393,802 S 4/1998 Collette et al.
5,762,221 A 6/1998 Tobias et al.
D397,614 S 9/1998 Krishnakumar et al.
D402,895 S 12/1998 Takahashi et al.
D404,308 S 1/1999 Takahashi et al.
5,888,598 A 3/1999 Brewster et al.
D407,649 S * 4/1999 McCallister et al. ..... D9/520
D407,650 S 4/1999 Takahashi et al.
D411,453 S 6/1999 Piccioli et al.
5,908,128 A 6/1999 Krishnakumar et al.
D413,519 S 9/1999 Eberle et al.
5,971,184 A * 10/1999 Krishnakumar et al. ..... 215/384
5,988,417 A 11/1999 Cheng et al.
6,016,932 A 1/2000 Gaydosh et al.
D419,882 S 2/2000 Bretz et al.
D420,592 S 2/2000 Bretz et al.
6,036,037 A 3/2000 Scheffer et al.
D423,365 S 4/2000 Eberle
6,044,996 A 4/2000 Carew et al.
6,044,997 A 4/2000 Ogg
6,062,409 A 5/2000 Eberle
D426,460 S 6/2000 Krishnakumar et al.
D427,905 S 7/2000 Eberle
6,092,688 A 7/2000 Eberle
D429,647 S 8/2000 Warner et al.
D430,493 S 9/2000 Weick
6,112,925 A * 9/2000 Nahill et al. ..... 215/382
D434,330 S 11/2000 Rowe et al.
D440,157 S 4/2001 Lichtman et al.
D440,158 S 4/2001 Bretz et al.
D440,877 S 4/2001 Lichtman et al.
D441,294 S 5/2001 Lichtman et al.
6,230,912 B1 5/2001 Rashid
D445,033 S 7/2001 Bretz et al.
6,257,433 B1 7/2001 Ogg et al.
D446,126 S 8/2001 Bretz et al.
D447,411 S 9/2001 Lichtman et al.
6,296,131 B2 * 10/2001 Rashid ..... 215/383
6,347,717 B1 2/2002 Eberle
D454,500 S 3/2002 Bretz et al.
D465,158 S 11/2002 Peek et al.
D466,021 S 11/2002 Thierjung et al.
D466,819 S 12/2002 Darr et al.
6,494,333 B2 12/2002 Sasaki et al.
D469,358 S 1/2003 Bryant et al.
D469,359 S 1/2003 Bryant et al.
D469,695 S 2/2003 Bryant et al.
D469,696 S 2/2003 Bryant et al.
D470,773 S 2/2003 Darr et al.
D472,470 S 4/2003 Bretz et al.
6,554,146 B1 4/2003 DeGroff et al.
D476,236 S 6/2003 Ungrady et al.
6,585,125 B1 7/2003 Peek
D479,690 S 9/2003 DeGroff
6,616,001 B2 9/2003 Saito et al.
D480,957 S 10/2003 Mooney et al.
D485,765 S 1/2004 Thierjung et al.
6,722,514 B2 4/2004 Renz
6,739,467 B2 5/2004 Saito et al.
D494,475 S 8/2004 Thierjung et al.
D497,551 S 10/2004 Gamel et al.
6,830,158 B2 12/2004 Yourist
6,841,262 B1 * 1/2005 Beck et al. ..... 428/542.8
D502,108 S 2/2005 Gamel et al.
D503,625 S 4/2005 Nelson et al.
D503,885 S 4/2005 Bretz et al.
D504,063 S 4/2005 Bretz et al.
D506,675 S 6/2005 Bretz et al.
D506,676 S 6/2005 Bretz et al.
D506,677 S 6/2005 Bretz et al.
D507,491 S 7/2005 Bretz et al.
D507,609 S 7/2005 Bretz et al.
D507,749 S 7/2005 Bretz et al.
D508,857 S 8/2005 Bretz et al.
6,932,230 B2 8/2005 Pedmo et al.
D510,526 S 10/2005 Bretz et al.
7,025,219 B2 4/2006 Heisner et al.
7,032,770 B2 * 4/2006 Finlay et al. ..... 220/669
D525,530 S 7/2006 Livingston et al.
D527,643 S 9/2006 Gottlieb
7,172,087 B1 * 2/2007 Axe et al. ..... 215/382
D538,660 S 3/2007 Gatewood
7,198,164 B2 4/2007 Yourist et al.
D548,106 S 8/2007 Martinez et al.
7,258,244 B2 8/2007 Ungrady
D551,081 S 9/2007 Ohara et al.
7,267,242 B2 9/2007 Tanaka et al.
D555,499 S 11/2007 Ross
7,334,695 B2 2/2008 Bysick et al.
7,334,696 B2 2/2008 Tanaka et al.
7,347,339 B2 3/2008 Bangi et al.
7,364,046 B2 4/2008 Joshi et al.
7,416,089 B2 8/2008 Kraft et al.
7,416,090 B2 8/2008 Mooney et al.
D579,339 S 10/2008 Shmagin
7,451,886 B2 11/2008 Lisch et al.
7,469,796 B2 * 12/2008 Kamineni et al. ..... 215/382
D584,627 S 1/2009 Lepoitevin
7,543,713 B2 * 6/2009 Trude et al. ..... 215/373
D598,779 S 8/2009 Lepoitevin
D610,015 S 2/2010 Yourist et al.
7,694,842 B2 4/2010 Melrose
7,699,183 B2 4/2010 Matsuoka et al.
7,748,551 B2 7/2010 Gatewood et al.
7,748,552 B2 7/2010 Livingston et al.
7,757,874 B2 7/2010 Ross
D621,271 S 8/2010 Soni
7,780,025 B2 8/2010 Simpson, Jr. et al.
D623,529 S 9/2010 Yourist et al.
D624,427 S 9/2010 Yourist et al.
7,798,349 B2 9/2010 Maczek et al.
D630,515 S 1/2011 Bretz et al.
7,861,876 B2 1/2011 Stowitts
7,980,404 B2 * 7/2011 Trude et al. ..... 215/375
8,020,717 B2 * 9/2011 Patel ..... 215/375
8,047,388 B2 11/2011 Kelley et al.
8,091,720 B2 * 1/2012 Colloud ..... 215/384
8,308,007 B2 * 11/2012 Mast et al. ..... 215/381
8,328,033 B2 * 12/2012 Mast ..... 215/381
8,381,496 B2 * 2/2013 Trude et al. ..... 53/440
2001/0030166 A1 10/2001 Ozawa et al.
2004/0000533 A1 * 1/2004 Kamineni et al. ..... 215/373
2005/0279728 A1 * 12/2005 Finlay et al. ..... 215/382
2006/0070977 A1 4/2006 Howell et al.

(56) References Cited

U.S. PATENT DOCUMENTS

| | | | | |
|---|---|---|---|---|
| 2006/0113274 | A1 | 6/2006 | Keller et al. | |
| 2006/0131257 | A1 | 6/2006 | Gatewood et al. | |
| 2006/0157439 | A1 | 7/2006 | Howell | |
| 2007/0131644 | A1 | 6/2007 | Melrose | |
| 2008/0087628 | A1 | 4/2008 | Bangi et al. | |
| 2008/0197105 | A1* | 8/2008 | Boukobza | 215/381 |
| 2009/0020497 | A1 | 1/2009 | Tanaka et al. | |
| 2009/0065468 | A1 | 3/2009 | Hata et al. | |
| 2009/0159556 | A1 | 6/2009 | Patcheak et al. | |
| 2009/0166314 | A1* | 7/2009 | Matsuoka | 215/384 |
| 2009/0184127 | A1 | 7/2009 | Mooney | |
| 2009/0261058 | A1 | 10/2009 | Pritchett, Jr. | |
| 2009/0261059 | A1 | 10/2009 | Pritchett, Jr. | |
| 2009/0283495 | A1 | 11/2009 | Lane et al. | |
| 2009/0321383 | A1 | 12/2009 | Lane | |
| 2010/0089865 | A1 | 4/2010 | Oguchi et al. | |
| 2010/0155359 | A1* | 6/2010 | Simon et al. | 215/382 |
| 2010/0163513 | A1 | 7/2010 | Pedmo | |
| 2010/0176081 | A1 | 7/2010 | Kamineni et al. | |
| 2010/0206837 | A1* | 8/2010 | Deemer et al. | 215/381 |
| 2010/0206838 | A1* | 8/2010 | Mast et al. | 215/382 |
| 2010/0206839 | A1 | 8/2010 | Tanaka et al. | |
| 2010/0206892 | A1* | 8/2010 | Mast | 220/669 |
| 2010/0213204 | A1 | 8/2010 | Melrose | |
| 2010/0230378 | A1* | 9/2010 | Colloud | 215/384 |
| 2010/0270259 | A1* | 10/2010 | Russell et al. | 215/382 |
| 2010/0320218 | A1 | 12/2010 | Tanaka | |
| 2011/0017700 | A1 | 1/2011 | Patcheak et al. | |
| 2011/0073559 | A1 | 3/2011 | Schlies et al. | |
| 2012/0248003 | A1* | 10/2012 | Hunter et al. | 206/524.6 |

FOREIGN PATENT DOCUMENTS

| | | |
|---|---|---|
| JP | 7 164436 | 6/1995 |
| JP | 09240647 | 9/1997 |
| JP | 10029614 | 2/1998 |
| JP | 2004 090425 | 3/2004 |
| JP | 2008 189721 | 8/2008 |
| JP | 2009 045877 | 3/2009 |
| WO | WO 2004/080828 | 9/2004 |

OTHER PUBLICATIONS

International Search Report and Written Opinion for PCT application No. PCT/US2012/067795 mailed on Mar. 13, 2013, by Detlef Meyer.

* cited by examiner

PLASTIC CONTAINER HAVING SIDEWALL RIBS WITH VARYING DEPTH

CROSS-REFERENCE TO RELATED APPLICATIONS

The present application claims priority to U.S. Provisional Patent Application No. 61/567,086 filed on Dec. 5, 2011 and entitled "Plastic Container with Varying Depth Ribs," the entire contents of which are incorporated herein by reference and should be considered a part of this specification.

BACKGROUND

1. Field

The present application generally relates to plastic containers, particularly to plastic containers designed to hold liquids while resisting deformation.

2. Description of the Related Art

Plastic containers have been used as a replacement for glass or metal containers in the packaging of beverages for several decades. The most common plastic used in making beverage containers today is polyethylene terephthalate (PET). Containers made of PET are transparent, thin-walled, and have the ability to maintain their shape by withstanding the force exerted on the walls of the container by their contents. PET resins are also reasonably priced and easy to process. PET bottles are generally made by a process that includes the blow-molding of plastic preforms which have been made by injection molding of the PET resin.

Advantages of plastic packaging include lighter weight and decreased breakage as compared to glass, and lower costs overall when taking both production and transportation into account. Although plastic packaging is lighter in weight than glass, there is still great interest in creating the lightest possible plastic packaging so as to maximize the cost savings in both transportation and manufacturing by making and using containers that contain less plastic, while still exhibiting good mechanical properties.

SUMMARY

The bottling industry is moving in the direction of removing auxiliary packaging from cases or pallets. A case of bottles with film only and no paperboard is called a "film only conversion" or "lightweighting" of auxiliary packaging. The removal of supporting elements such as paperboard places additional stress on a bottle, which increases the structural demands on the bottle. In certain embodiments, a bottle design can provide one or more of the benefits of reducing bending and point loading failures. The disclosed design embodiments can alleviate the stresses during shipping and handling (including film only packaging) while maintaining ease of blow molding. In certain embodiments, a bottle design uses less resin for the same or similar mechanical performance, resulting in a lightweight product.

Embodiments of the bottle disclosed herein may use polyethylene terephthalate (PET), which has viscoelastic properties of creep and relaxation. As a plastic, PET and other resins tend to relax at temperatures normally seen during use. This relaxation is a time dependent stress relieving response to strain. Bending can provide exaggerated strains over what would be seen in tensile loading. Due to exaggerated strains, the relaxation in bending can be much more severe. Bending happens at multiple length scales. Bending can happen at the length scale of the bottle or on a small length scale. An example of the bottle length scale bending is a person bending the bottle in his/her hands, or bending experienced during packing in a case on a pallet. An example of the small scale is the flexing or folding of ribs or other small features on the wall of the bottle. In response to loads at the first, larger length scale, ribs flex at the local, smaller length scale. When they are held in this position with time, the ribs will permanently deform through relaxation.

Further, embodiments of the bottles disclosed herein may undergo pressurization. Pressure inside a bottle can be due to the bottle containing a carbonated beverage. Pressure inside a bottle can be due to pressurization procedures or processes performed during bottling and packaging. For example, a bottle can be pressurized to help the bottle retain its shape. As another example, the bottle can be pressurized with certain gases to help preserve a beverage contained in the bottle.

Embodiments of the bottles disclosed herein have varying depth ribs that achieve a balance of strength and rigidity to resist the bending described above while maintaining hoop strength. Varying depth ribs can smoothly transition around the circumference of the bottle from a flattened and/or shallow depth rib portion to a deep rib portion. A collection of flattened and/or shallow depth ribs act as recessed columns in the body of the bottle that distribute bending and top load forces along the wall to resist leaning and crumbling. The collection of flattened and/or shallow depth ribs can help the bottle retain its shape during pressurization, such as, for example, help inhibit stretching of the bottle when pressurized. Inhibiting stretching of the bottle helps retain desired bottle shape to aid in packaging of the bottles as discussed herein by, for example, maintaining a substantially constant height of the bottle. Inhibiting stretching of the bottle can help with applying a label to a label portion of the bottle. For example, with a label applied to a bottle, inhibiting stretching of the bottle helps retain a constant length or height of the bottle at the label panel portion, which can help prevent tearing of the label and/or prevent the label from at least partially separating from the bottle (i.e., failure of the adhesive between the bottle and the label).

The deep rib portions provide hoop strength and make the bottle body more rigid and/or stiffer when gripped by a user. A balance may be achieved between flattened and/or shallow ribs and deep ribs to attain a desired resistance to bending, leaning, and/or stretching while maintaining stiffness in a lightweight bottle. In some embodiments, at least some of the aforementioned desired qualities may be further achieved through a steeper bell portion of a bottle. A steeper bell portion can increase top load performance in a lightweight bell. A lightweight bottle body and bell leaves more resin for a thicker base of the bottle, which can increase stability. A thicker base may better resist bending and top load forces and benefits designs with a larger base diameter with respect to the bottle diameter for tolerance even when the base is damaged during packaging, shipping, and/or handling.

Containers disclosed herein comprise a base. The container can further comprise a grip portion connected to the base through a constant depth base rib and defining a grip portion perimeter that is substantially perpendicular to a central axis. The container can further comprise a label panel portion connected to the grip portion and defining a label portion perimeter that is substantially perpendicular to the central axis. The container can further comprise a bell with an obtuse angle as measured from the central axis to a wall of the bell of at least 120 degrees, the bell connected to the label panel portion through a shoulder and leading upward and radially inward to a finish connected to the bell, the finish adapted to receive a closure. The container can further comprise a plurality of angulating and varying depth ribs positioned substantially along the perimeter of the grip portion wherein each angulating and varying depth rib comprises a plurality of shallow sections, a plurality of middle sections, and a plurality of deep sections. The container can further comprise a plurality of constant depth ribs positioned substantially along the perimeter of the label portion. The shallow sections have a rib depth less than a rib depth of the middle sections. The deep sections have a rib depth greater than the rib depth of the middle sections. The shallow sections of the varying depth ribs can substantially vertically line up along the central axis and form recessed columns. The recessed columns are configured to resist at least one of bending, leaning, crumbling, or stretching. The plurality of deep sections is configured to provide hoop strength.

Containers disclosed herein comprise a base. The container can further comprise a grip portion connected to the base through a constant depth base rib and defining a grip portion perimeter that is substantially perpendicular to a central axis. The container can further comprise a label panel portion connected to the grip portion and defining a label portion perimeter that is substantially perpendicular to the central axis. The container can further comprise a bell with an obtuse angle as measured from the central axis to a wall of the bell of at least 120 degrees, the bell connected to the label panel portion through a shoulder and leading upward and radially inward to a finish connected to the bell, the finish adapted to receive a closure. The container can further comprise a plurality of angulating and varying depth ribs positioned substantially along the perimeter of the grip portion wherein each angulating and varying depth rib comprises a plurality of shallow sections, a plurality of middle sections, and a plurality of deep sections. The container can further comprise a plurality of varying depth ribs positioned substantially along the perimeter of the label portion wherein each varying depth rib comprises a plurality of shallow sections, a plurality of middle sections, and a plurality of deep sections. The shallow sections of the angulating and varying depth ribs have a rib depth less than a rib depth of the middle sections of the angulating and varying depth ribs. The deep sections of the angulating and varying depth ribs have a rib depth greater than the rib depth of the middle sections of the angulating and varying depth ribs. The shallow sections of the varying depth ribs have a rib depth less than a rib depth of the middle sections of the varying depth ribs. The deep sections of the varying depth ribs have a rib depth greater than the rib depth of the middle sections of the varying depth ribs. The shallow sections of the angulating and varying depth ribs can substantially vertically line up along the central axis and form a first plurality of recessed columns. The shallow sections of the varying depth ribs can substantially vertically line up along the central axis and form a second plurality of recessed columns. The first and second pluralities of recessed columns are configured to resist at least one of bending, leaning, crumbling, or stretching. The plurality of deep sections is configured to provide hoop strength.

In some embodiments, the first plurality of recessed columns substantially vertically lines up along the central axis with the second plurality of recessed columns, and/or the varying depth ribs of the label portion angulate.

Containers disclosed herein comprise a base. The container further comprises a sidewall connected to the base, the sidewall defining a sidewall perimeter that is substantially perpendicular to a central axis and extending substantially along the central axis to define at least part of an interior of the container. The container can further comprise a bell connected to the sidewall and leading upward and radially inward to a finish connected to the bell, the finish adapted to receive a closure. The container further comprises a varying depth rib positioned substantially along the sidewall perimeter. The varying depth rib comprises a shallow section, a middle section, and a deep section. The shallow section has a rib depth less than a rib depth the middle section. The deep section has a rib depth greater than the rib depth of the middle section. The shallow section of the rib is configured to resist at least one of bending, leaning, crumbling, or stretching. The deep section is configured to provide hoop strength.

In some embodiments, the varying depth rib transitions from the shallow section to the middle section to the deep section as at least one of a gradual transition or an abrupt transition; the varying depth rib has a shape of at least one of trapezoidal, triangular, rounded, squared, oval, or hemispherical; the varying depth rib angulates around the sidewall perimeter; the varying depth rib has a plurality of shallow sections, a plurality of middle sections, and a plurality of deep sections; the contain further comprises a plurality of varying depth ribs wherein at least two shallow sections substantially vertically line up along the central axis and form a recessed column whereby the recessed column is configured to resist at least one of bending, leaning, crumbling, or stretching; the plurality varying depth ribs have a plurality of shallow sections, a plurality of middle sections, and a plurality of deep sections; the container further comprises a rib of a constant depth; and/or the bell has an obtuse angle as measured from the central axis to a wall of the bell of at least 120 degrees.

The foregoing is a summary and thus contains, by necessity, simplifications, generalization, and omissions of detail; consequently, those skilled in the art will appreciate that the summary is illustrative only and is not intended to be in any way limiting. Other aspects, features, and advantages of the devices and/or processes and/or other subject matter described herein will become apparent in the teachings set forth herein. The summary is provided to introduce a selection of concepts in a simplified form that are further described below in the Detailed Description. This summary is not intended to identify key features or essential features of any subject matter described herein.

BRIEF DESCRIPTION OF THE DRAWINGS

The foregoing and other features of the present disclosure will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings.

DETAILED DESCRIPTION

Figure 1A:
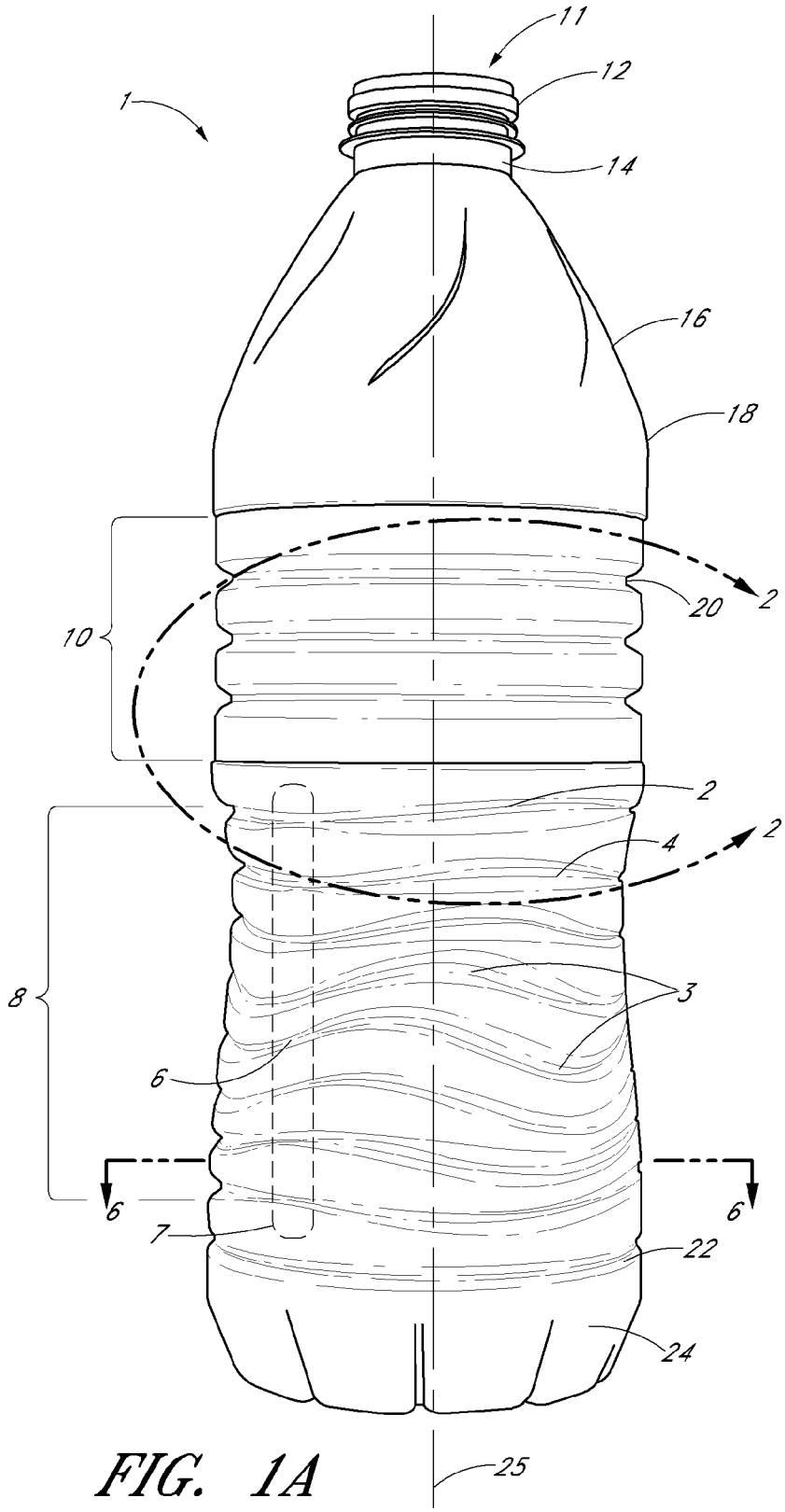
FIG. 1A illustrates a 3D-rendering of an embodiment of a bottle.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the FIGURES, may be arranged, substituted, combined, and designed in a wide variety of different configurations, all of which are explicitly contemplated and make part of this disclosure.

In particular, disclosed herein are articles, including preforms and containers, which utilize less plastic in their construction while maintaining the ease of processing and excellent structural properties associated with current commercial designs.

Referring to FIG. 1A, an embodiment of the container is a bottle 1 with a base 24 that extends up into a base rib 22. Connected to the base 24, the grip portion 8 comprises a plurality of grip portion ribs 3. As illustrated in FIG. 1A, grip portion ribs 3 (positioned in the grip portion 8) may vary in depth by separating or transitioning the rib into at least three portions of a deep rib 2, a middle rib 4, and a flattened and/or shallow rib 6 to be discussed in further detail below. In the illustrated embodiment, the grip portion ribs 3 swirl or angulate around the grip portion 8. In some embodiments, the grip portion ribs 3 include straight and/or constant depth ribs such as the label panel ribs 20 (positioned in a label portion 10), including a combination of straight and swirl or angulating ribs.

Referring to FIG. 1A, a label portion 10 is connected to the grip portion 8 and comprises one or more label panel ribs 20. In some embodiments, the label panel ribs 20 are a combination of straight and swirl or angulating ribs as discussed herein. The label panel portion 10 transitions into a shoulder 18, which connects to a bell 16. The bell 16 may include scallops (including as illustrated) or other design features or it may be smooth and generally unornamented. The bell 16 connects to a neck 14, which connects to a finish 12. From the label portion 10, the bell 16 leads upwards and radially inward, relative to a central axis 25, to the neck 14 and finish 12. The finish 12 can be adapted to receive a closure to seal contents in the bottle 1. The finish 12 defines an opening 11 that leads to an interior of the bottle 1 for containing a beverage and/or other contents. The interior can be defined at least one of the finish 12, the neck 14, the bell 16, the shoulder 18, the label portion 10, the grip portion 8, or the base 24.

A substantially vertical wall comprising the grip portion 8 and label portion 10 between the base 24 and bell 16, extending substantially along the central axis 25 to define at least part of the interior of the bottle 1, can be considered a sidewall of the bottle 1. The perimeter of the sidewall is substantially perpendicular to the central axis 25 of the interior. The sidewall defines at least part of the interior of the bottle 1. The finish 12, the neck 14, the bell 16, the shoulder 18, the label portion 10, the grip portion 8, and the base 24 can each define a respective perimeter (substantially perpendicular to the central axis 25) corresponding to that portion. For example, the label portion 10 has a label portion perimeter. As another example, the grip portion 8 has a grip portion perimeter.

Figure 1B:
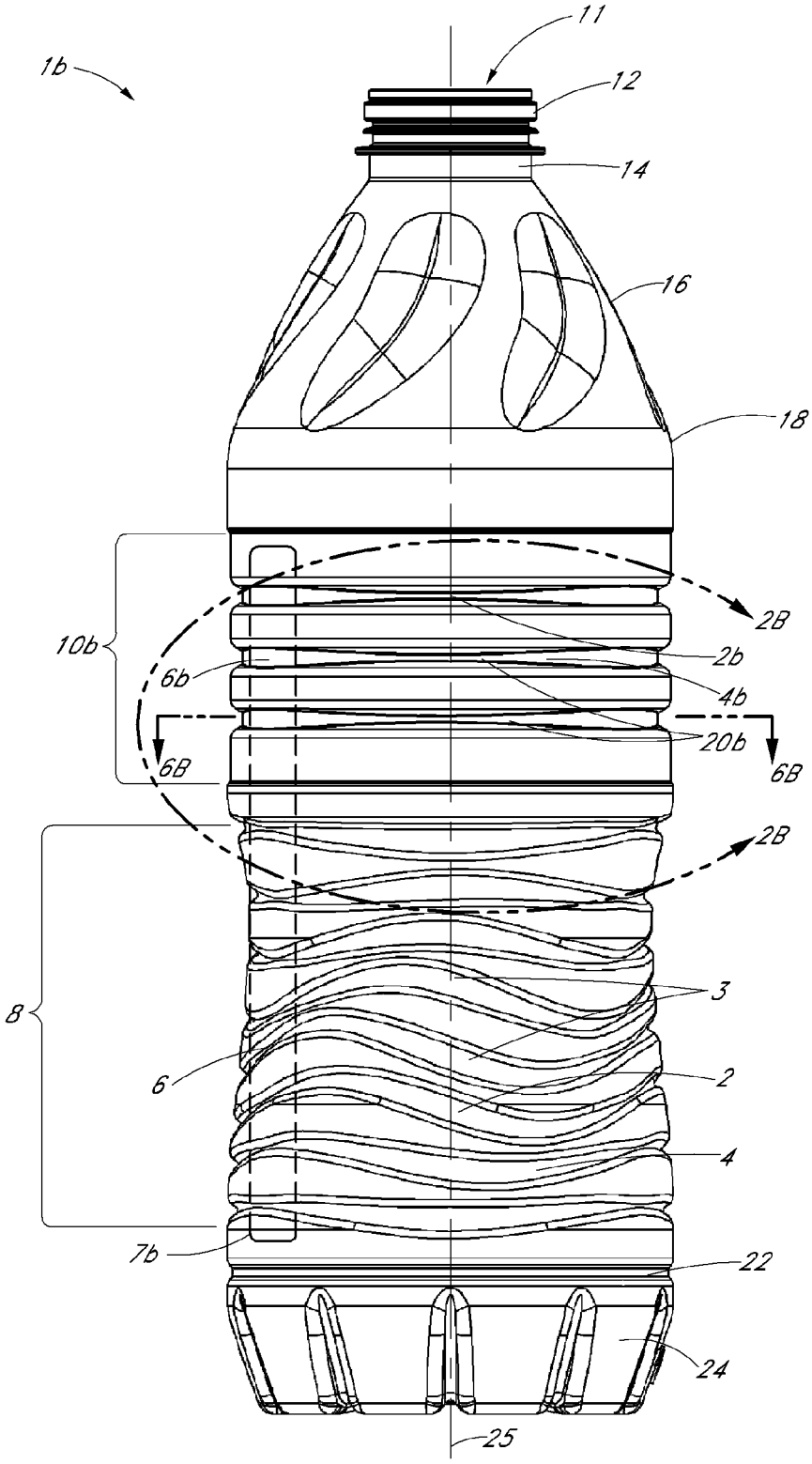
FIG. 1B illustrates a 3D-rendering of an embodiment of a bottle.

As illustrated in FIG. 1B, the label portion 10*b* may have label panel ribs 20*b* that vary in depth. The label panel rib 20*b* may vary in depth by separating or transitioning the rib into at least three portions of a deep rib 2*b*, a middle rib 4*b*, and a flattened and/or shallow rib 6*b* to be discussed in further detail below. As shown in FIG. 1B, the label panel ribs 20*b* are straight around the label portion perimeter. In some embodiments, the label panel ribs 20*b* are a combination of straight and swirl or angulating ribs. As shown in FIG. 1B, the label portion 10*b* may have three label panel ribs 20*b*. In some embodiments, the label portion 10*b* have 1, 2, 4, 5, 6, 7, 8, 9, 10, 11, or 12 panel ribs 20*b*, including ranges bordered and including the foregoing values.

The number of ribs, including base ribs 22, grip portion ribs 3, and/or label panel ribs 20, 20*b*, may vary from 1 to 30 ribs every 10 centimeters of any rib containing portion of the bottle, such as, but not limited to the grip portion 8 and/or label panel portion 10, including 1, 2, 3, 4, 5, 6, 7, 8, 9, 10, 11, 12, 13, 14, 15, 16, 17, 18, 19, 20, 21, 22, 23, 24, 25, 26, 27, 28, or 29 ribs every 10 centimeters, including ranges bordered and including the foregoing values. The aforementioned 10 centimeter section that is used to measure the number of ribs need not be actually 10 centimeters in length. Rather, 10 centimeters is used illustratively to provide a ratio for the number of ribs. Further, while in certain embodiments, the illustrated cross-section of the ribs, including base ribs 22, grip portion ribs 3, and/or label panel ribs 20, 20*b*, are trapezoidal or triangular-shaped, as will be discussed in further detail below, the ribs may have any shape known in the art, including but not limited to, rounded, squared, oval, hemispherical, and the like. The bottom portion of the bottle includes the base 24, which may be of any suitable design, including those known in the art and that illustrated.

Figure 2A:
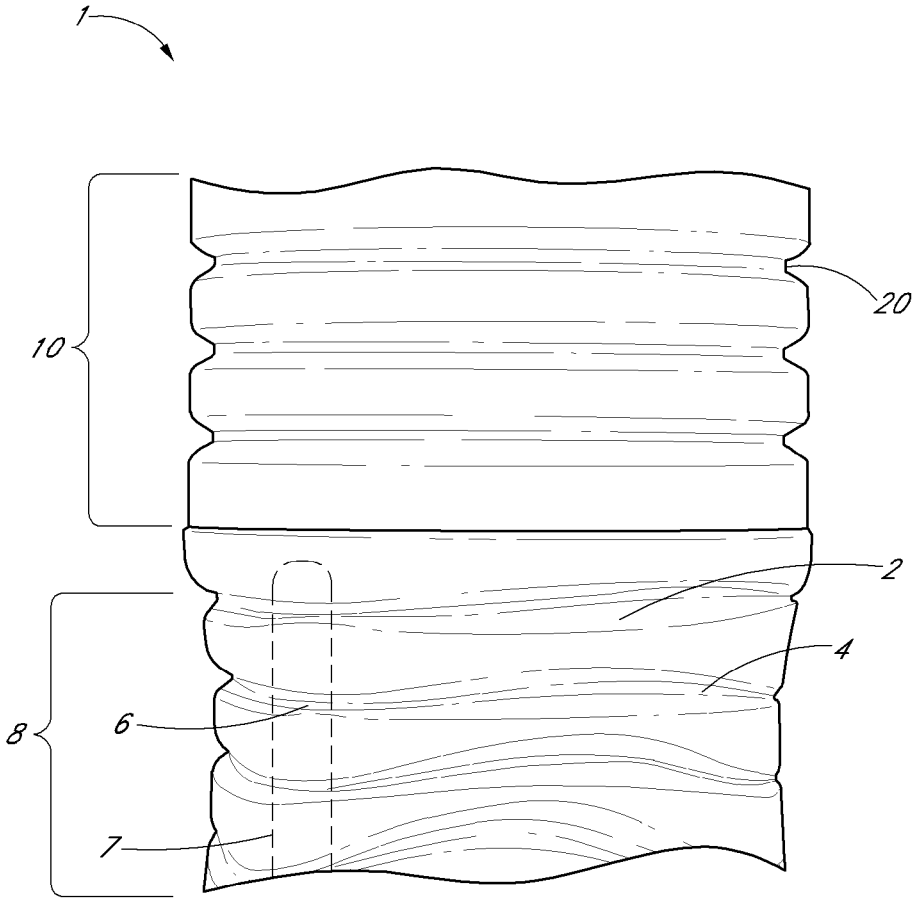
FIG. 2A illustrates a 3D-rendering of an embodiment showing the varying depth features of the ribs.

In the embodiment illustrated in FIG. 2A, each of the grip portion ribs 3 comprise a deep rib 2, a middle rib 4, and a flattened and/or shallow rib 6 sections. The deep, middle, and shallow rib sections may also be called deep, middle, and shallow ribs as shorthand, but it is to be understood that these terms are meant to define sections of a rib in the grip portion 8, label portion 10, and base rib 22. A varying depth grip portion rib 3 transitions from a deep rib 2 to a middle rib 4, then to a flattened and/or shallow rib 6. The varying depth grip portion rib 3 comprises one or more of each of a deep rib, a middle rib, and a shallow rib in any combination. For example, a grip portion rib may include (in order around the circumference of the bottle) a deep rib, middle rib, shallow rib, middle rib, deep rib, middle rib, shallow rib, middle rib, deep rib, middle rib, shallow rib, and middle rib. As shown in FIG. 1A, the transition between the ribs may be gradual. In some embodiments, the transition is more abrupt. The term "middle" of a middle rib 4 refers to a rib of certain depth and does not mean a location.

Figure 2B:
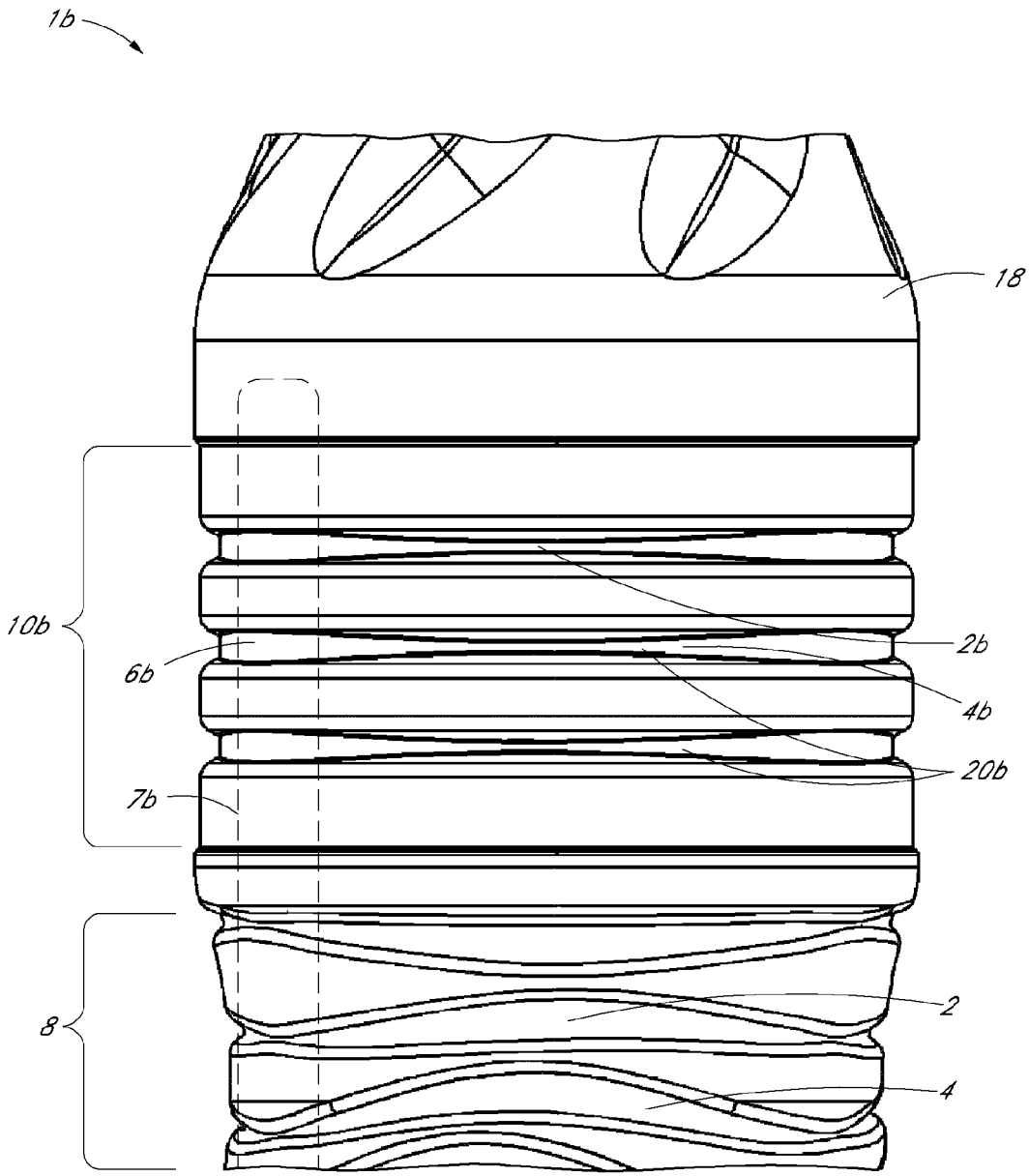
FIG. 2B illustrates a 3D-rendering of an embodiment showing the varying depth features of the ribs.

In the embodiment illustrated in FIG. 2B, each of the label panel ribs 20*b* comprise a deep rib 2*b*, a middle rib 4*b*, and a flattened and/or shallow rib 6*b* sections. A varying depth label panel rib 20*b* transitions from a deep rib 2*b* to a middle rib 4*b*, then to a flattened and/or shallow rib 6*b*. The varying depth label panel rib 20*b* comprises one or more of each of a deep rib, a middle rib, and a shallow rib in any combination. For example, a label panel rib 20*b* may include (in order around the circumference of the bottle) a deep rib, middle rib, shallow rib, middle rib, deep rib, middle rib, shallow rib, middle rib, deep rib, middle rib, shallow rib, and middle rib. As shown in FIG. 1B, the transition between the ribs is gradual. In some embodiments, the transition is more abrupt. The term "middle" of a middle rib 4*b* refers to a rib of certain depth and does not mean a location.

Figure 3:
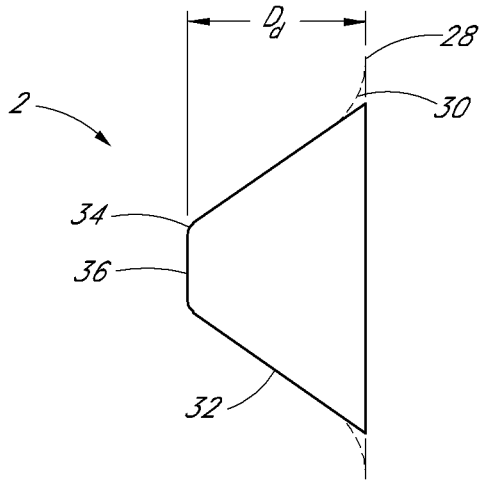
FIG. 3 illustrates an embodiment showing a cross-section of a deep rib.
Figure 4:
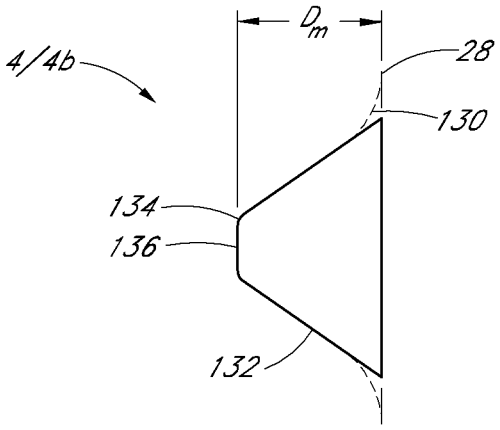
FIG. 4 illustrates an embodiment showing a cross-section of a middle rib.
Figure 5:
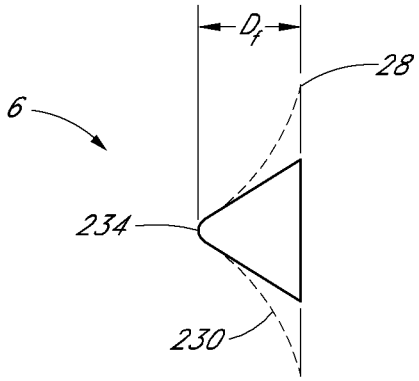
FIG. 5 illustrates an embodiment showing a cross-section of a flattened and/or shallow rib.

FIGS. 3-5 illustrate embodiments where the deep rib 2 is a depth $D_d$ that is larger than a depth $D_m$ of the middle rib 4, which is larger than a depth $D_f$ of the flattened and/or shallow rib 6. The transition between the varying depths $D_d$, $D_m$, and $D_f$ is smooth as depicted in FIG. 2A. In some embodiments, the transition is some other form such as a step change connecting the varying depth portions or sections of the grip portion rib 3. In the illustrated embodiments, a varying depth grip portion rib 3 has three deep rib 2 portions, six middle rib 4 portions, and three flattened and/or shallow rib 6 portions. As disclosed herein, the term "portions" can be equivalent to the term "sections" in reference to varying depth ribs.

Figure 7A:
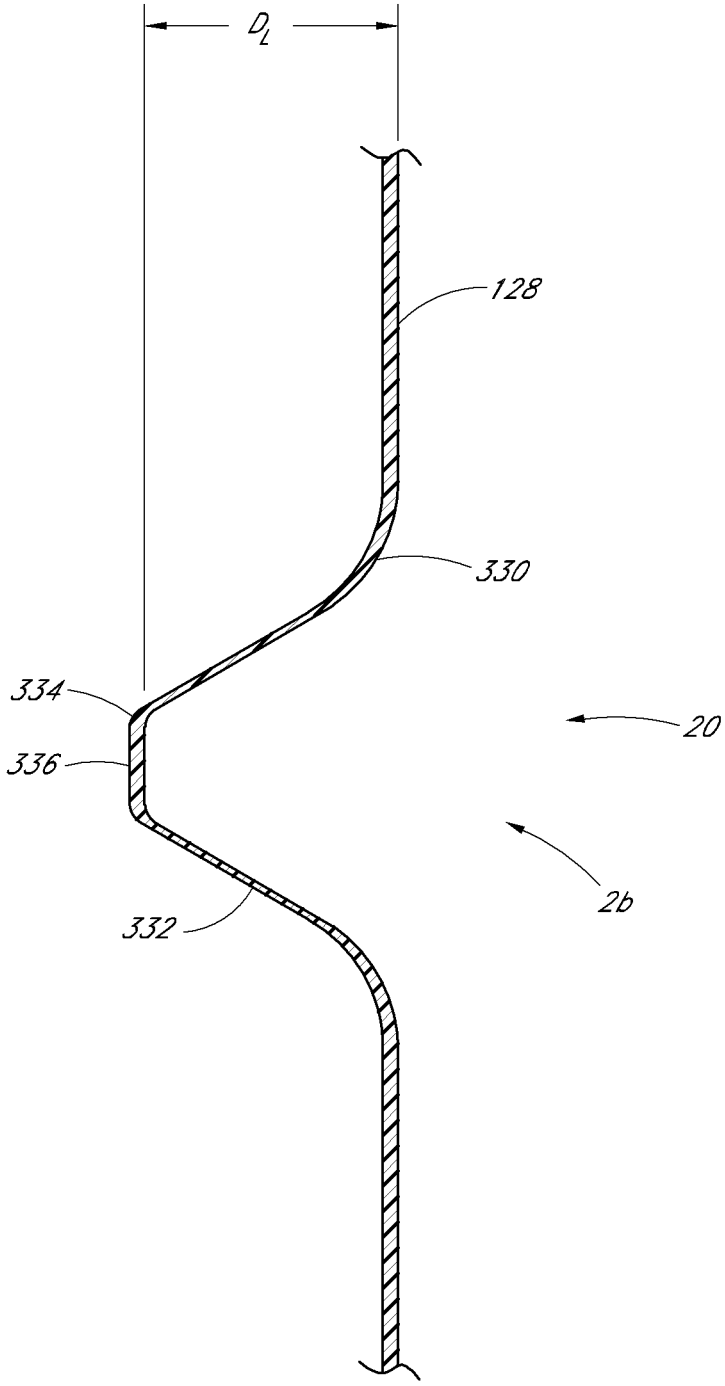
FIG. 7A illustrates an embodiment showing a cross-section of a label panel rib.
Figure 7B:
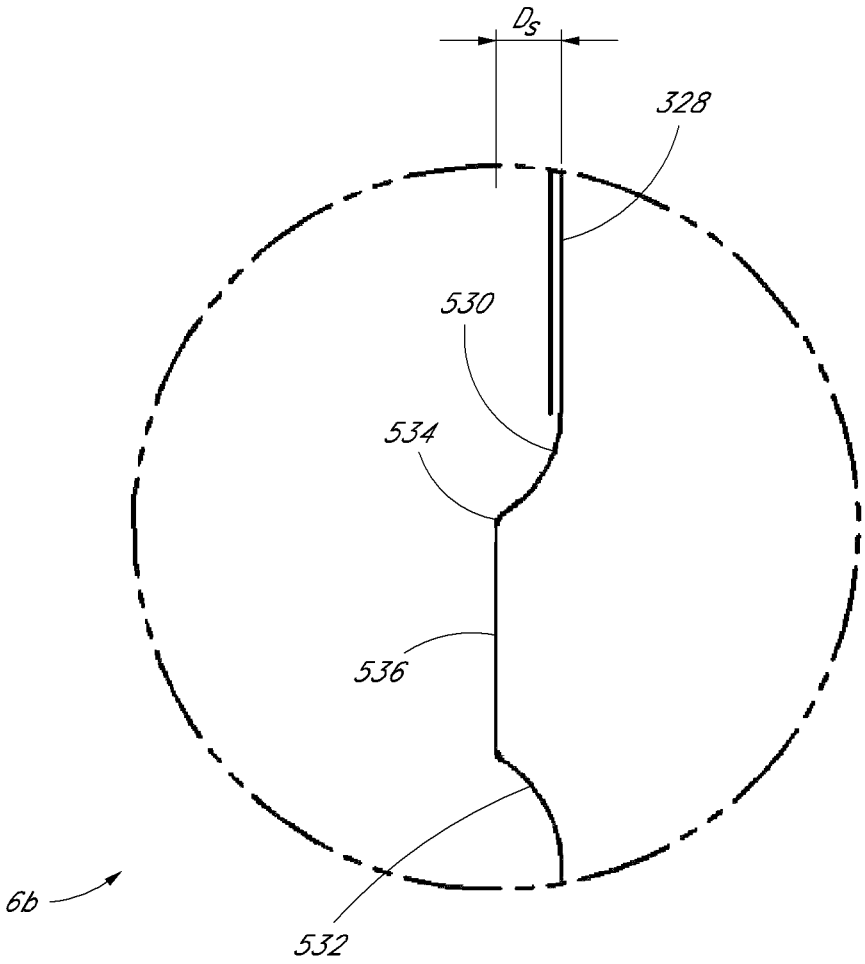
FIG. 7B illustrates an embodiment showing a cross-section of a label panel rib.

FIGS. 4, 7A, and 7B illustrate embodiments where the deep rib 2*b* is a depth $D_L$ that is larger than a depth $D_m$ of the middle rib 4*b*, which is larger than a depth $D_s$ of the flattened and/or shallow rib 6*b*. The transition between the varying depths $D_L$, $D_m$, and $D_s$ is smooth as depicted in FIG. 2B. In some embodiments, the transition is some other form such as a step change connecting the varying depth portions or sections of the label portion rib 20*b*. In the illustrated embodiments, a varying depth label portion rib 20*b* has three deep rib 2*b* portions, six middle rib 4*b* portions, and three flattened and/or shallow rib 6*b* portions.

Figure 6A:
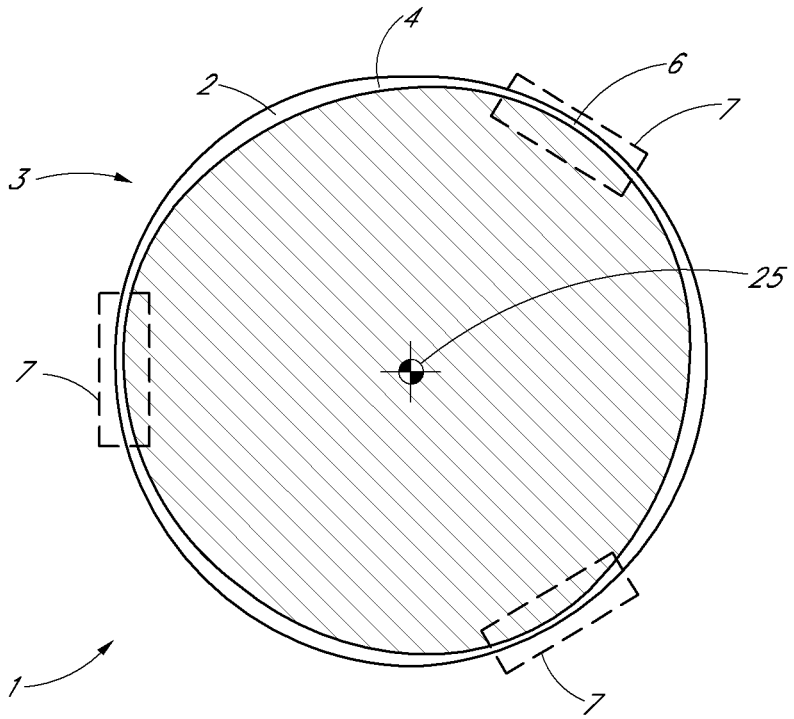
FIG. 6A illustrates an embodiment showing a cross-section of the bottle.

Referring to FIG. 6A, an embodiment showing a cross-section of the bottle 1, looking down the vertical or central axis 25, illustrates a cross-section of a varying depth grip portion rib 3. As disclosed herein, the term "vertical axis" can be equivalent of the term "central axis". The depth of the varying depth grip portion rib 3 varies from deep ribs 2 to flattened and/or shallow ribs 6. The one or more flattened and/or shallow ribs 6 form an equivalent of recessed columns 7 at portions where a plurality flattened and/or shallow ribs 6 substantially vertically line up along the vertical or central axis 25 of the bottle 1 as illustrated in FIGS. 1A and 2A. A plurality of deep ribs 2 substantially vertically line up along the vertical or central axis 25 of the bottle 1 as illustrated in FIGS. 1A and 2A. A plurality of middle ribs 4 substantially vertically line up along the vertical or central axis 25 of the bottle 1 as illustrated in FIGS. 1A and 2A.

In the illustrated embodiments with three lined-up flattened and/or shallow rib 6 portions of FIG. 5, the bottle respectively has three recessed columns 7. As illustrated in FIG. 6, The three recessed columns 7 may be equally spaced apart around the circumference of the bottle and located on the opposite side of the bottle circumference from the deep rib 2 portions. In some embodiments, the flattened and/or shallow ribs 6 are unequally spaced apart around the circumference of the bottle 1. Any number of recessed columns 7 may be incorporated into a design of the bottle 1 by increasing or decreasing the number of flattened and/or shallow ribs 6 that substantially vertically line up along the vertical or central axis 25. For instance, the bottle may have as few as 1 or up to 10 recessed columns 7, including 2, 3, 4, 5, 6, 7, 8, or 9 recessed columns 7, including ranges bordered and including the foregoing values. The collections of flattened and/or shallow ribs 6 that form recessed columns 7 provide resistance to leaning, load crushing, and/or stretching. Leaning can occur when during and/or after bottle packaging, a bottle experiences top load forces (tangential forces or otherwise) from other bottles and/or other objects stacked on top of the bottle. Similarly, top load crushing can occur due to vertical compression (or otherwise) forces from bottles and/or other objects stacked on top. Stretching can occur when a bottle is pressurized. The recessed columns 7 transfer the resulting tangential or compression forces along the wall to the base 24 and increase bottle 1 rigidity. Deep ribs 2 of the grip portion rib 3 provide the hoop strength that can be equivalent to the hoop strength of normal depth ribs. As with the flattened and/or shallow rib 6 portions, the deep rib 2 portions may vary from 1 to 10 in number on the grip portion ribs 3, including 2, 3, 4, 5, 6, 7, 8, or 9 deep rib 2 portions, including ranges bordered and including the foregoing values.

Figure 6B:
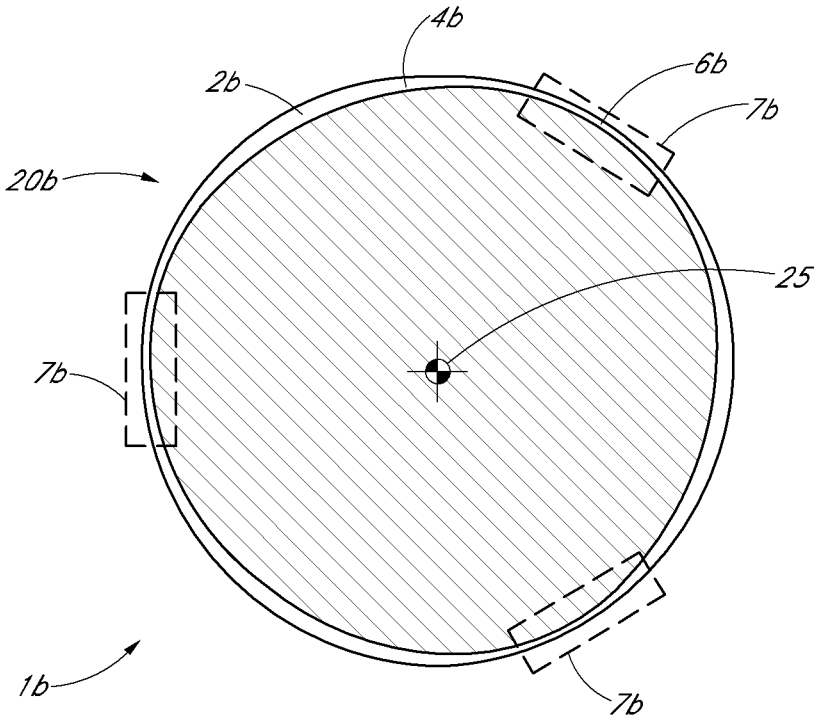
FIG. 6B illustrates an embodiment showing a cross-section of the bottle.

Referring to FIG. 6B, an embodiment showing a cross-section of the bottle 1*b*, looking down the vertical or central axis 25, illustrates a cross-section of a varying depth label panel rib 20*b*. The depth of the varying depth label panel rib 20*b* varies from deep ribs 2*b* to flattened and/or shallow ribs 6*b*. The one or more flattened and/or shallow ribs 6*b* form an equivalent of recessed columns 7*b* at portions where a plurality flattened and/or shallow ribs 6*b* substantially vertically line up along the vertical or central axis 25 of the bottle 1*b* as illustrated in FIGS. 1B and 2B. The recessed columns 7*b* can include one or more flattened and/or shallow ribs 6 of the grip portion 8 as discussed herein. A plurality of deep ribs 2*b* substantially vertically line up along the vertical or central axis 25 of the bottle 1*b* as illustrated in FIGS. 1B and 2B. A plurality of middle ribs 4*b* substantially vertically line up along the vertical or central axis 25 of the bottle 1*b* as illustrated in FIGS. 1B and 2B.

In the illustrated embodiments with three lined-up flattened and/or shallow rib 6*b* portions of FIG. 7B, the bottle respectively has three recessed columns. The flattened and/or shallow ribs 6*b* of the label panel ribs 20B can vertically line up along the vertical or central axis 25 with the flattened and/or shallow ribs 6 of the grip portion ribs 3 to form the three recessed columns 7*b*. As illustrated in FIG. 1B, the recessed columns 7*b* may extend along a majority or substantial entirety of the sidewall (e.g., height and/or length) of the bottle 1*b*.

In some embodiments, the flattened and/or shallow ribs 6*b* of the label panel ribs 20B are vertically misaligned with the flattened and/or shallow ribs 6 of the grip portion ribs 3 such that the label portion 10 has a set of recessed columns and the grip portion 8 has another set of recessed columns. Thus, the recessed column of the label portion 10 can be vertically misaligned from the recessed columns of the grip portion 8.

As illustrated in FIGS. 1B and 2B, the plurality of deep ribs 2*b* of the label portion 10 may substantially vertically line up along the vertical or central axis 25 with the plurality of deep ribs 2 of the grip portion 8. In some embodiments, the plurality of deep ribs 2*b* of the label portion 10 is vertically misaligned with the plurality of deep ribs 2 of the grip portion 8. The plurality of middle ribs 4*b* label portion 10 substantially vertically line up along the vertical or central axis 25 with the middle ribs 4 of the grip portion 8 as illustrated in FIGS. 1B and 2B. In some embodiments, the plurality of middle ribs 4*b* label portion 10 is vertically misaligned with the middle ribs 4 of the grip portion 8.

As illustrated in FIG. 6B, the three recessed columns 7*b* may be equally spaced apart around the circumference of the bottle and located on the opposite side of the bottle circumference from the deep rib 2*b* portions. In some embodiments, the flattened and/or shallow ribs 6, 6*b* are unequally spaced apart around the circumference of the bottle 1*b*. Any number of recessed columns 7*b* may be incorporated into a design of the bottle 1*b* by increasing or decreasing the number of flattened and/or shallow ribs 6, 6*b* that substantially vertically line up along the vertical or central axis 25. For instance, the bottle may have as few as 1 or up to 10 recessed columns 7*b*, including 2, 3, 4, 5, 6, 7, 8, or 9 recessed columns 7*b*, including ranges bordered and including the foregoing values. The collections of flattened and/or shallow ribs 6*b* that form recessed columns 7*b* provide resistance to leaning, load crushing, and/or stretching as discussed herein. The recessed columns 7*b* transfer the resulting tangential or compression forces along the wall to the base 24 and increase bottle 1*b* rigidity. Deep ribs 2*b* of the label panel rib 20*b* provide the hoop strength that can be equivalent to the hoop strength of normal depth ribs. As with the flattened and/or shallow rib 6*b* portions, the deep rib 2*b* portions may vary from 1 to 10 in number on the label panel rib 20*b*, including 2, 3, 4, 5, 6, 7, 8, or 9 deep rib 2*b* portions, including ranges bordered and including the foregoing values.

In some embodiments, grip portion ribs 3 are any combination of constant depth ribs and varying depth ribs described above. For instance, the constant versus varying depth rib may vary to be every other grip portion rib 3, or every 2, 3, 4, 5 or 6 grip portion rib 3, including ranges bordered and including the foregoing values. A constant depth rib is illustrated by a label panel rib 20 or base rib 22 of the bottle 1 in FIG. 1A. The illustrated embodiment in FIG. 1A shows that the label panel portion 10 has constant depth label panel ribs 20. However, any combination and order of varying depth and/or swirl ribs described above may be incorporated into the label panel portion 10 of bottle 1. For example, in some embodiments, the label panel ribs 20*b* are any combination of constant depth ribs and varying depth ribs described above. For instance, the constant versus varying depth rib may vary to be every other label panel rib 20*b*, or every 2, 3, 4, 5 or 6, including ranges bordered and including the foregoing values. Further, while the illustrated embodiment shows a single, constant depth base rib 22, any combination and order of varying depth and/or swirl ribs described above may also be incorporated into the base 24 of bottle 1. The shape of the constant depth base rib 22 may be any shape illustrated in FIGS. 3-5 or other shapes known in the art.

Referring to a cross-section of a deep rib 2 embodiment illustrated in FIG. 3, the deep rib 2 has a land 28, which is part of the grip portion 8, that is connected to an outer radius 30. The outer radius 30 is joined to an inner radius 34 by a connecting wall 32. The inner radius 34 is joined to an opposing inner radius 34 on the other side of the deep rib 2 by a root wall 36, which in turn is connected to a connecting wall 32, connected to an outer radius 30 connecting to the land 28. The depth $D_d$ as measured from the land 28 to the root wall 36 may vary from 1 to 10 millimeters, including 1.1, 1.2, 1.3, 1.4, 1.5, 1.6, 1.7, 1.8, 1.9, 2, 2.1, 2.2, 2.3, 2.4, 2.5, 2.6, 2.7, 2.8, or 2.9 millimeters, or 1 to 9, 1 to 7, 1 to 5, or 1 to 3 millimeters, including ranges bordered and including the foregoing values. The length of the root wall 36 may vary from 0.5 to 3 millimeters, including 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, or 2.9 millimeters, including ranges bordered and including the foregoing values. The ratio of $D_d$ to the length of the root wall 36 may vary from 1:3 to 20:1, including 1:2, 1:1, 2:1, 3:1, 4:1, 5:1, 6:1, 7:1, 8:1, 9:1, 10:1, 11:1, 12:1, 13:1, 14:1, 15:1, 16:1, 17:1, 18:1, or 19:1, including ranges bordered and including the foregoing values. The radius of the inner radius 34 may vary from 0.1 to 0.3 millimeters, including 0.15, 0.2, or 0.25 millimeters, including ranges bordered and including the foregoing values. The acute angle between the two connecting walls 32 may vary from 60 to 80 degrees, including 62.5, 65, 67.5, 70, 72.5, 75, or 77.5 degrees, including ranges bordered and including the foregoing values.

The embodiment of FIG. 3 illustrates that the cross-section of deep ribs 2 forms a substantially trapezoidal shape. In some embodiments, the cross-sectional shape of deep ribs 2 are any shape illustrated in FIGS. 3-5 or other shapes known in the art. As discussed above, the deep ribs 2 provide hoop strength for the bottle 1. Deep ribs 2 make the bottle 1 feel stiffer and thus, it can be desirable to have deep ribs 2 in the grip portion 8. However, deep ribs 2 with a large depth $D_d$ can cause the bottle 1 to crumble more easily under top load forces. The ratio of depth $D_d$ to either base diameter $L_d$ or shoulder diameter $L_s$ (see FIGS. 10A and 10B) may vary from 1:5 to 1:150, including to 1:10, 1:20, 1:30, 1:40, 1:50, 1:60, 1:70, 1:80, 1:90, 1:100, 1:110, 1:120, 1:130, or 1:140, including ranges bordered and including the foregoing values. Thus, embodiments of the bottles disclosed herein work toward achieving a balance between desired stiffness and desired top load strength and/or bending resistance by balancing deep rib 2 depth $D_d$ and the ratio of the trapezoidal-shaped to triangular-shaped ribs of FIG. 5 (or other shapes known in the art) as will be discussed in further detail below.

Referring to a cross-section of a middle rib 4 embodiment illustrated in FIG. 4, the middle rib 4 has a land 28, which is part of the grip portion 8, that is connected to an outer radius 130. The outer radius 130 is joined to an inner radius 134 by a connecting wall 132. The inner radius 134 is joined to an opposing inner radius 134 on the other side of the middle rib 4 by a root wall 136, which in turn is connected to a connecting wall 132, connected to an outer radius 130 connecting to the land 28. The depth $D_m$ as measured from the land 28 to the root wall 136 may vary from 0.5 to 5 millimeters, including 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, or 4.9 millimeters, including ranges bordered and including the foregoing values. The length of the root wall 136 may vary from 0.3 to 2.5 millimeters, including 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, or 2.4 millimeters, including ranges bordered and including the foregoing values. The ratio of $D_m$ to the length of the root wall 136 may vary from 1:5 to 20:1, including 1:4, 1:3, 1:2, 1:1, 2:1, 3:1, 4:1, 5:1, 6:1, 7:1, 8:1, 9:1, 10:1, 11:1, 12:1, 13:1, 14:1, 15:1, 16:1, 17:1, 18:1, or 19:1, including ranges bordered and including the foregoing values. The ratio of $D_d$ of the deep ribs 2 to the $D_m$ of middle ribs 4 may vary from 1:1 to 20:1, including 2:1, 3:1, 4:1, 5:1, 6:1, 7:1, 8:1, 9:1, 10:1, 11:1, 12:1, 13:1, 14:1, 15:1, 16:1, 17:1, 18:1, or 19:1, including ranges bordered and including the foregoing values. The radius of the inner radius 134 may vary from 0.1 to 0.3 millimeters, including 0.15, 0.2, or 0.25 millimeters, including ranges bordered and including the foregoing values. The acute angle between the two connecting walls 132 may vary from 60 to 80 degrees, including 62.5, 65, 67.5, 70, 72.5, 75, or 77.5 degrees, including ranges bordered and including the foregoing values.

The embodiment of FIG. 4 illustrates that the cross-section of middle ribs 4 forms a substantially trapezoidal shape. In some embodiments, the cross-sectional shape of middle ribs 4 are any shape illustrated in FIGS. 3-5 or other shapes known in the art. As discussed above, the middle ribs 4 acts as a transitional rib from deep ribs 2 to flattened and/or shallow ribs 6. Further, the middle ribs 4 may provide some benefits of both a deep rib 2 and a flattened and/or shallow rib 6 such as hoop strength and bending resistance, respectively.

Referring to a cross-section of a flattened and/or shallow rib 6 embodiment illustrated in FIG. 5, the flattened and/or shallow rib 6 has a land 28, which is part of the grip portion 8, that is connected to an outer radius 230. The outer radius 230 is joined to an inner radius 234 by a connecting wall 232. The inner radius 234 is joined to a connecting wall 232, connected to an outer radius 230 connecting to the land 28. The depth $D_f$ as measured from the land 28 to the inner radius 234 may vary from 0 to 2.5 millimeters, including 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, or 2.4 millimeters, including ranges bordered and including the foregoing values. The ratio of $D_d$ of the deep ribs 2 to the $D_f$ of the flattened and/or shallow ribs 6 may vary from 1:1 to 100:1, including 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, 24:1, 25:1, 26:1, 27:1, 28:1, or 29:1, or 1:1 to 90:1, 1:1 to 80:1, 1:1 to 70:1, 1:1 to 60:1, 1:1 to 50:1, 1:1 to 40:1, 1:1 to 30:1 or 1:1 to 20:1, including ranges bordered and including the foregoing values, including where $D_f$ is zero, resulting in an infinite ratio. The ratio of $D_m$ of the middle ribs 4 to the $D_f$ of the flattened and/or shallow ribs 6 may vary from 1:1 to 50:1, including 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, or 24:1 or 1:1 to 40:1, 1:1 to 30:1, or 1:1 to 20:1, including ranges bordered and including the foregoing values, including where $D_f$ is zero, resulting in an infinite ratio. The radius of the inner radius 234 may vary from 0.1 to 0.3 millimeters, including 0.15, 0.2, or 0.25 millimeters, including ranges bordered and including the foregoing values. The acute angle between the two connecting walls 232 may vary from 50 to 70 degrees, including 52.5, 55, 57.5, 60, 62.5, 63.56, 65, or 67.5 degrees, including ranges bordered and including the foregoing values.

The embodiment of FIG. 5 illustrates that the cross-section of flattened and/or shallow ribs 6 forms substantially a triangular shape. As illustrated in FIG. 5, a triangular shape can be described as a triangle standing on one of its corners with a rounded corner forming the inner radius 234. While FIG. 5 illustrates a flattened and/or shallow rib 6 with a triangular shape, the cross-sectional shape of flattened and/or shallow ribs 6 may be any shape illustrated in FIGS. 3-5 or other shapes known in the art. A triangle-shaped rib may have better recovery and/or resiliency, but may have less hoop strength. As discussed above, collections of flattened and/or shallow ribs 6 that form recessed columns 7 make the bottle 1 more rigid. Recessed columns 7 transfer the resulting tangential or compression forces to the base 24 that can minimize or prevent leaning and/or bending. Further, recessed columns 7 can inhibit stretching substantially along the length or height of the bottle 1. As FIG. 6A illustrates, embodiments of the bottle may minimize the triangle-shaped or flattened and/or shallow ribs 6 to 20-30%, including 21, 22, 23, 24, 25, 26, 27, 28, or 29%, of the bottle circumference, resulting in a respective 70-80%, including 71, 72, 73, 74, 75, 76, 77, 78, or 79%, of the bottle circumference being trapezoid-shaped or deep ribs 2 and middle ribs 4, including ranges bordered and including the foregoing values. However, any ratio of triangle-shaped to trapezoidal ribs, or other shapes known in the art, may be utilized.

Referring to an embodiment of a label panel rib 20 cross-section illustrated in FIG. 7A, the label panel rib 20 has a land 128, which is part of the label panel portion 10, that is connected to an outer radius 330. The outer radius 330 is joined to an inner radius 334 by a connecting wall 332. The inner radius 334 is joined to an opposing inner radius 334 on the other side of the label panel rib 20 by a root wall 336, which in turn is connected to a connecting wall 332, connected to an outer radius 330 connecting to the land 128. The depth $D_L$ as measured from the land 128 to the root wall 336 may vary from 0.5 to 10 millimeters, including 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.3, 3.4, 3.5, 3.6, 3.7, 3.9, 4, 4.1, 4.2, 4.3, 4.4, 4.5, 4.6, 4.7, 4.8, or 4.9 millimeters, 0.5 to 9, 0.5 to 7, 0.5 to 5, or 0.5 to 3 millimeters, including ranges bordered and including the foregoing values. The length of the root wall 336 may vary from 0.3 to 2.5 millimeters, including 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, or 2.4 millimeters, including ranges bordered and including the foregoing values. The ratio of $D_L$ to the length of the root wall 336 may vary from 1:5 to 35:1, including 1:4, 1:3, 1:2, 1:1, 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, 24:1, 25:1, 26:1, 27:1, 28:1, 29:1, 30:1, 31:1, 32:1, 33:1, or 34:1, including ranges bordered and including the foregoing values. The radius of the inner radius 334 may vary from 0.1 to 0.3 millimeters, including 0.15, 0.2, or 0.25 millimeters, including ranges bordered and including the foregoing values. The radius of the outer radius 330 may vary from 0.5 to 3 millimeters, including 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, or 2.9 millimeters, including ranges bordered and including the foregoing values. The acute angle between the two connecting walls 332 may vary from 50 to 70 degrees, including 52.5, 55, 57.5, 60, 62.5, 65, or 67.5 degrees, including ranges bordered and including the foregoing values.

The embodiment of FIG. 7A illustrates that the cross-section of label panel rib 20 forms a substantially trapezoidal shape. In some embodiments, the cross-section of a label panel rib 20 is any shape illustrated in FIGS. 3-5 or other shapes known in the art. The label panel ribs 20 may act in a substantially similar manner as the deep ribs 2 and/or middle ribs 4 as discussed above. As also discussed above, label panel ribs 20 may have varying depth from deep ribs 2 to middle ribs 4 to flattened and/or shallow ribs 6, incorporating the recessed columns 7 feature, which can provide the benefits of hoop strength and/or bending resistance. The label panel ribs 20 may also swirl or angulate.

As illustrated in FIG. 1B, the label panel rib 20 illustrated in FIG. 7A may be the deep rib **2*b* of the varying depth label panel rib 20*b*. In some embodiments, the deep rib 2*b* of the varying depth label panel rib 20*b* can be the deep rib 2 of the grip portion ribs 3. The deep rib 2*b* can transition to the middle rib 4, 4*b* (FIG. 4), then to the flattened and/or shallow rib 6*b* illustrated in FIG. 7**B.

Referring to a cross-section of a flattened and/or shallow rib **6*b* embodiment illustrated in FIG. 7B, the flattened and/or shallow rib 6*b* has a land 328, which is part of the label portion 10, that is connected to an outer radius 530. The outer radius 530 can connect directly to an inner radius 534 such that an inner connecting wall 532 is the continuation of the outer radius 530 along substantially the same radius of curvature. The outer radius 530 can connect to the inner radius 534** without the connecting wall 532. The radius of the outer radius 530 may vary from 0.5 to 2.5 millimeters, including 0.6, 0.7, 0.8, 0.9, 1, 1.1, 1.2, 1.3, 1.4, 1.5, 1.6, 1.7, 1.8, 1.9, 2, 2.1, 2.2, 2.3, and 2.4, including ranges bordered and including the foregoing values. In some embodiments, the outer radius 530 is joined to an inner radius 534 by a connecting wall 532. The inner radius 534 is joined to an opposing inner radius 534 on the other side of the flattened and/or shallow rib 6*b* by a root wall 536, which in turn is connected to a connecting wall 532, connected to an outer radius 530 connecting to the land 328. The inner radius 534 can be smaller than the outer radius 530 to give the flattened and/or shallow rib 6*b* a knob-shape and/or generally a trapezoidal-shape in a cross-sectional profile as illustrated in FIG. 7B. In some embodiments, the radius of the outer radius 530 and/or the inner radius 534 vary from 0.1 to 0.3 millimeters, including 0.15, 0.2, or 0.25 millimeters, including ranges bordered and including the foregoing values.

The depth $D_s$ as measured from the land 328 to the inner radius 534 may vary from 0 to 2.5 millimeters, including 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, or 2.4 millimeters, including ranges bordered and including the foregoing values. The ratio of $D_d$ of the deep ribs 2 (FIG. 3) to the $D_s$ of the flattened and/or shallow ribs 6*b* may vary from 1:1 to 100:1, including 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, 24:1, 25:1, 26:1, 27:1, 28:1, or 29:1, or 1:1 to 90:1, 1:1 to 80:1, 1:1 to 70:1, 1:1 to 60:1, 1:1 to 50:1, 1:1 to 40:1, 1:1 to 30:1 or 1:1 to 20:1, including ranges bordered and including the foregoing values, including where $D_s$ is zero, resulting in an infinite ratio. The ratio of $D_L$ of the deep ribs 2*b* (FIG. 7A) to the $D_s$ of the flattened and/or shallow ribs 6*b* may vary from 1:1 to 100:1, including 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, 24:1, 25:1, 26:1, 27:1, 28:1, or 29:1, or 1:1 to 90:1, 1:1 to 80:1, 1:1 to 70:1, 1:1 to 60:1, 1:1 to 50:1, 1:1 to 40:1, 1:1 to 30:1 or 1:1 to 20:1, including ranges bordered and including the foregoing values, including where $D_s$ is zero, resulting in an infinite ratio.

The length of the root wall 536 may vary from 0.3 to 4 millimeters, including 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.3, 3.4, 3.5, 3.6, 3.7, 3.8, or 3.9 millimeters, including ranges bordered and including the foregoing values. The ratio of $D_s$ to the length of the root wall 536 may vary from 1:40 to 10:1, including 1:39, 1:38, 1:37, 1:36, 1:35, 1:34, 1:33, 1:32, 1:31, 1:30, 1:29, 1:28, 1:27, 1:26, 1:25, 1:24, 1:23, 1:22, 1:21, 1:20, 1:19, 1:18, 1:17, 1:16, 1:15, 1:14, 1:13, 1:12, 1:11, 1:10, 1:9, 1:8, 1:7, 1:6, 1:5, 1:4, 1:3, 1:2, 1:1, 2:1, 3:1, 4:1, 5:1, 6:1, 7:1, 8:1, or 9:1, including ranges bordered and including the foregoing values, including where $D_s$ is zero, resulting in an infinite ratio. The ratio of $D_m$ of the middle ribs 4, 4*b* to the $D_s$ of the flattened and/or shallow ribs 6*b* may vary from 1:1 to 50:1, including 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, or 24:1 or 1:1 to 40:1, 1:1 to 30:1, or 1:1 to 20:1, including ranges bordered and including the foregoing values, including where $D_s$ is zero, resulting in an infinite ratio. The acute angle between the two connecting walls 532 may vary from 50 to 80 degrees, including 52.5, 55, 57.5, 60, 62.5, 63.56, 65, 67.5, 70, 72.5, 75, or 77.5 degrees, including ranges bordered and including the foregoing values.

The embodiment of FIG. 7B illustrates that the cross-section of flattened and/or shallow ribs 6*b* forms substantially a trapezoidal shape. A trapezoid-shaped flattened and/or shallow rib 6*b* can have the features and benefits of the triangle-shaped flattened and/or shallow ribs 6 as discussed herein while providing some of the features and benefits of the trapezoid-shaped ribs as discussed herein, such as, for example, a deep rib 2. While FIG. 7B illustrates a flattened and/or shallow rib 6*b* with a trapezoidal shape, the cross-sectional shape of flattened and/or shallow ribs 6*b* may be any shape illustrated in FIGS. 3-5, 7A, or other shapes known in the art. As discussed above, collections of flattened and/or shallow ribs 6, 6*b* that form recessed columns 7*b* make the bottle 1*b* more rigid. Recessed columns 7*b* transfer the resulting tangential or compression forces to the base 24 that can minimize or prevent leaning and/or bending. Further, recessed columns 7*b* can inhibit stretching substantially along the length or height of the bottle 1*b*.

Figure 8:
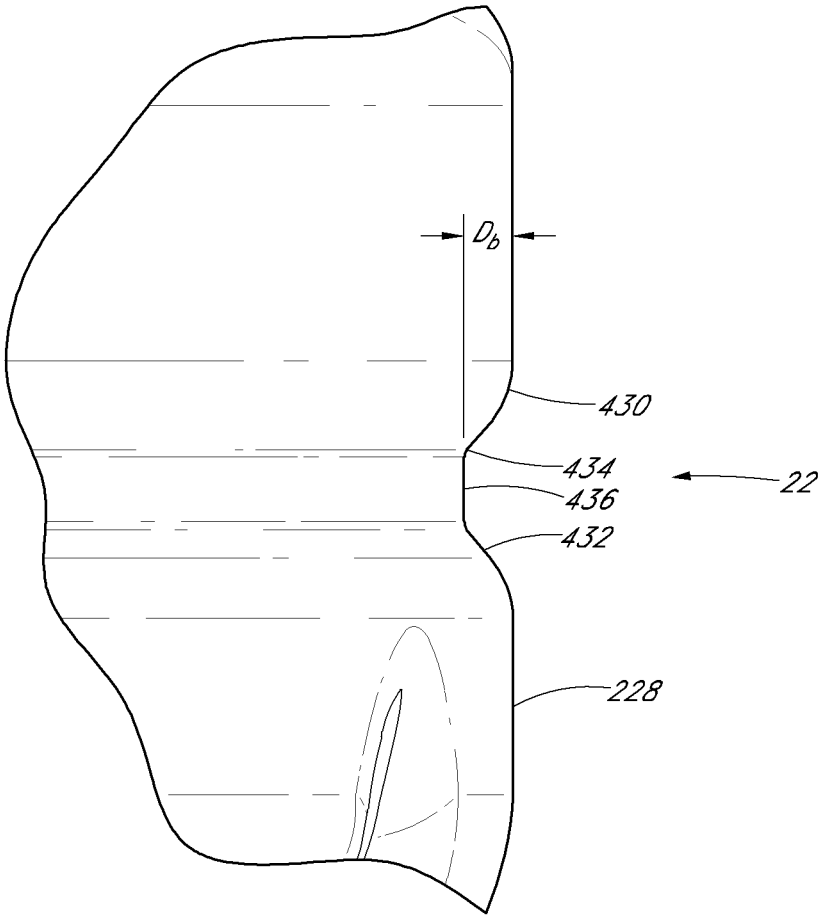
FIG. 8 illustrates an embodiment showing a base rib.

Referring to an embodiment of a base rib 22 detail illustrated in FIG. 8, the base rib 22 has a land 228, which is part of the base 24, that is connected to an outer radius 430. The outer radius 430 is joined to an inner radius 434 by a connecting wall 432. The inner radius 434 is joined to an opposing inner radius 434 on the other side of the base rib 22 by a root wall 436, which in turn is connected to a connecting wall 432, connected to an outer radius 430 connecting to the land 228. The depth $D_b$ as measured from the land 228 to the root wall 436 may vary from 0.3 to 10 millimeters, including 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, or 2.4 millimeters, or 0.3 to 9, 0.3 to 7, 0.3 to 5, or 0.3 to 3 millimeters, including ranges bordered and including the foregoing values. The length of the root wall 436 may vary from 0.5 to 3 millimeters, including 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, or 2.9 millimeters, including ranges bordered and including the foregoing values. The ratio of $D_b$ to the length of the root wall 436 may vary from 1:10 to 20:1, including 1:9, 1:8, 1:7, 1:6, 1:5, 1:4, 1:3, 1:2, 1:1, 2:1, 3:1, 4:1, 5:1, 6:1, 7:1, 8:1, 9:1, 10:1, 11:1, 12:1, 13:1, 14:1, 15:1, 16:1, 17:1, 18:1, or 19:1, including ranges bordered and including the foregoing values. The radius of the inner radius 434 may vary from 0.1 to 0.3 millimeters, including 0.15, 0.2, or 0.25 millimeters, including ranges bordered and including the foregoing values. The radius of the outer radius 430 may vary from 0.5 to 3 millimeters, including 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, or 2.9 millimeters, including ranges bordered and including the foregoing values. The angle between the two connecting walls 432 may vary from 80 to 120 degrees, including 82.5, 85, 87.5, 90, 92.5, 95, 97.5, 100, 102.5, 105, 107.5, 110, 112.5, 115, or 117.5 degrees, including ranges bordered and including the foregoing values.

The embodiment of FIG. 8 illustrates that the cross-section of a base rib 22 forms a substantially trapezoidal shape. In some embodiments, the cross-section of a base rib 22 is any shape illustrated in FIGS. 3-5 or other shapes known in the art. A trapezoid-shaped base rib 22 can reduce nesting at a processing line. The base rib 22 may act in a substantially similar manner as the deep ribs 2 and/or middle ribs 4 as discussed above. As also discussed above, base ribs 22 may have varying depth from deep ribs 2 to middle ribs 4 to flattened and/or shallow ribs 6, incorporating the recessed columns 7 feature, which provide the benefits of hoop strength and/or bending resistance. The base ribs 22 may also swirl or angulate.

Any embodiments of the ribs discussed herein can be used interchangeably in any portion of the bottle. For example, grip portion ribs 3 can be used in the label portion 10. As another example, the grip portion ribs 3 can be used as base ribs 22. As another example, label panel ribs 20 can be used in the grip portion 8. As another example, label panel ribs 20 can be used as base ribs 22. As another example, label panel ribs 20*b* can be used in the grip portion 8. As another example, label panel ribs 20*b* can be used as base ribs 22. As another example, the base rib 22 can be used in the label portion 10. As another example, the base rib 22 can be used in the grip portion 8.

Figures 9A, 9B:
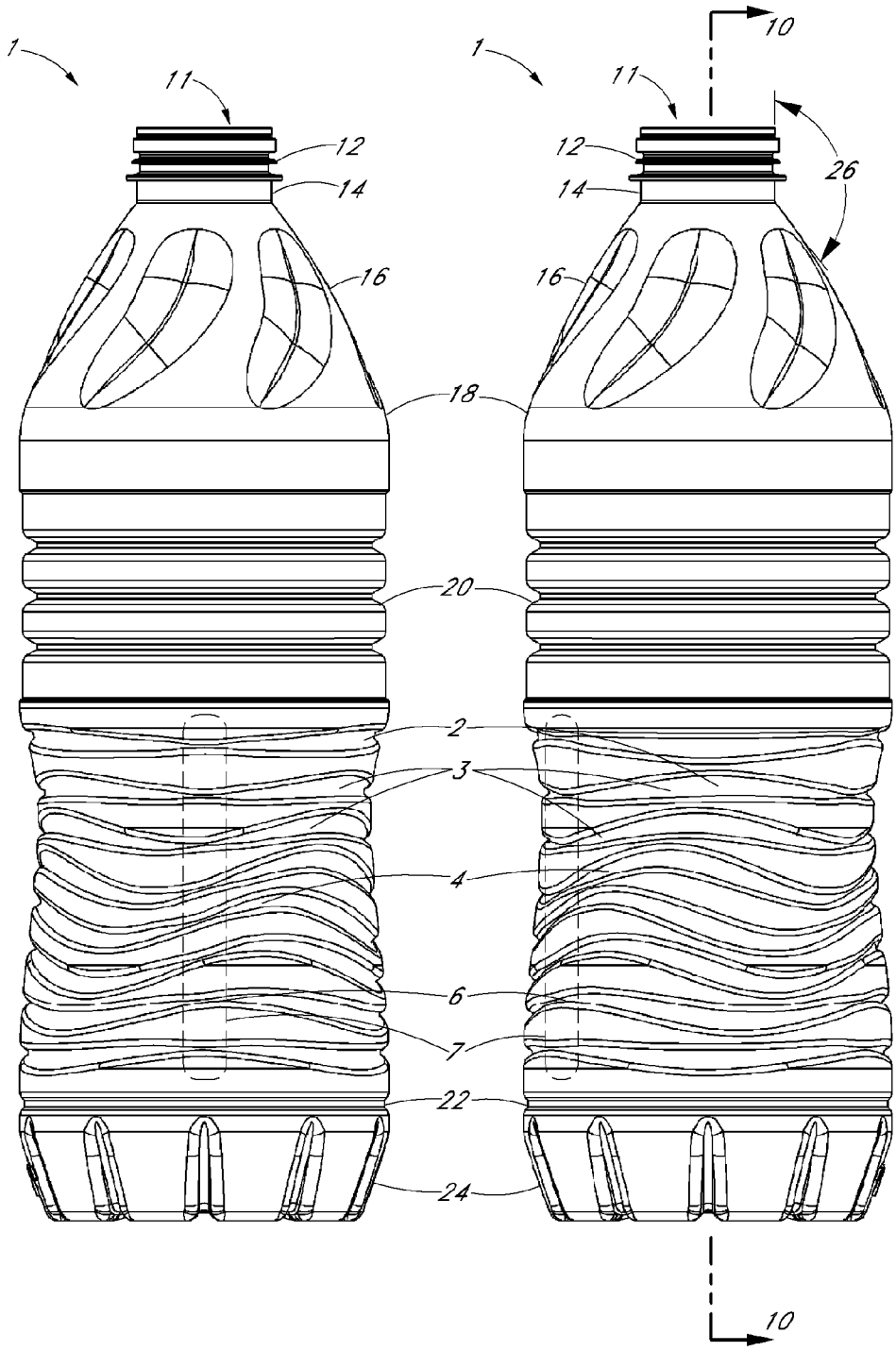
FIG. 9A illustrates an embodiment showing a wire frame embodiment of the bottle.
FIG. 9B illustrates an embodiment showing a wire frame embodiment of the bottle of FIG. 9A rotated 120 degrees.

The embodiment of FIGS. 9A and 9B illustrates a wire frame model of the bottle 1. FIG. 9B is a view of FIG. 9A rotated 120 degrees, representing a bottle 1 embodiment with three recessed columns 7 comprising substantially vertically lined up flattened and/or shallow ribs 6. FIG. 9A illustrates the front view of flat ribs or recessed column 7. FIG. 9B illustrates the front view of deep ribs 2. FIGS. 9A and 9B illustrate the smooth transition from flattened and/or shallow ribs 6 to deep ribs 2 of an embodiment. FIGS. 9A and 9B also illustrate a smooth swirl or angulation of the grip portion ribs 3. FIGS. 9A and 9B further illustrate the constant depth of the label panel ribs 20 and base rib 22. However, as discussed above, any combination or lack thereof of the aforementioned features may comprise a bottle 1 such as the label panel ribs 20 and base rib 22 incorporating recessed columns 7 and/or the grip portion ribs 3, but not swirling or angulating.

Figures 9C, 9D:
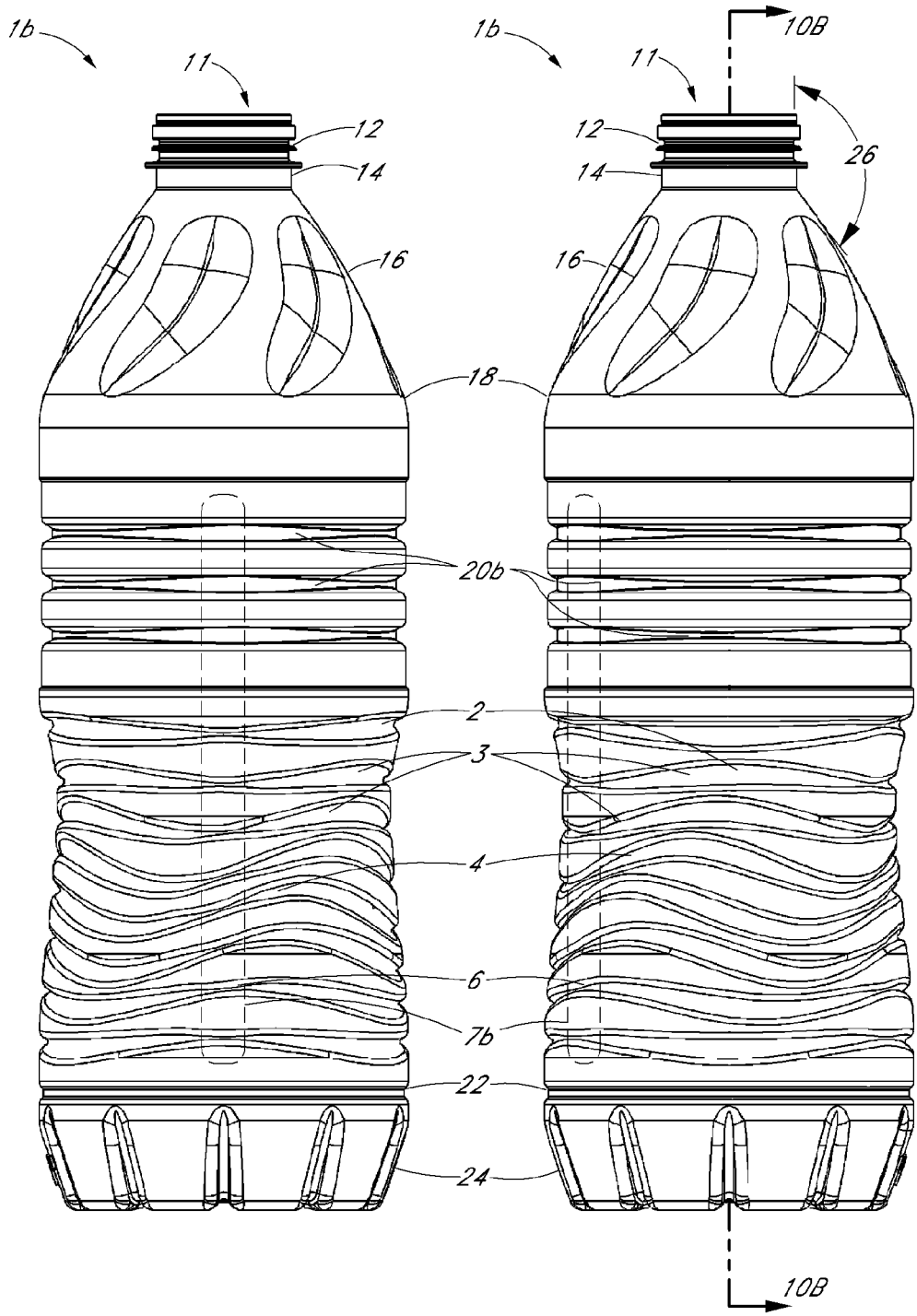
FIG. 9C illustrates an embodiment showing a wire frame embodiment of the bottle.
FIG. 9D illustrates an embodiment showing a wire frame embodiment of the bottle of FIG. 9C rotated 120 degrees.

The embodiment of FIGS. 9C and 9D illustrates a wire frame model of the bottle 1*b*. FIG. 9B is a view of FIG. 9A rotated 120 degrees, representing a bottle 1*b* embodiment with three recessed columns 7*b* comprising substantially vertically lined up flattened and/or shallow ribs 6, 6*b*. FIG. 9C illustrates the front view of flat ribs or recessed column 7*b*. FIG. 9D illustrates the front view of deep ribs 2, 2*b*. FIGS. 9C and 9D illustrate the smooth transition from flattened and/or shallow ribs 6, 6*b* to deep ribs 2, 2*b* of an embodiment. FIGS. 9C and 9D also illustrate a smooth swirl or angulation of the grip portion ribs 3. In some embodiments, the grip portion ribs 3 are substantially straight around the perimeter or circumference of the bottle. In some embodiments, the label panel ribs 20*b* swirl or angulate around the perimeter or circumference of the bottle. FIGS. 9C and 9D further illustrate the constant depth of the base rib 22. However, as discussed above, any combination or lack thereof of the aforementioned features may comprise a bottle 1*b*.

Figure 10A:
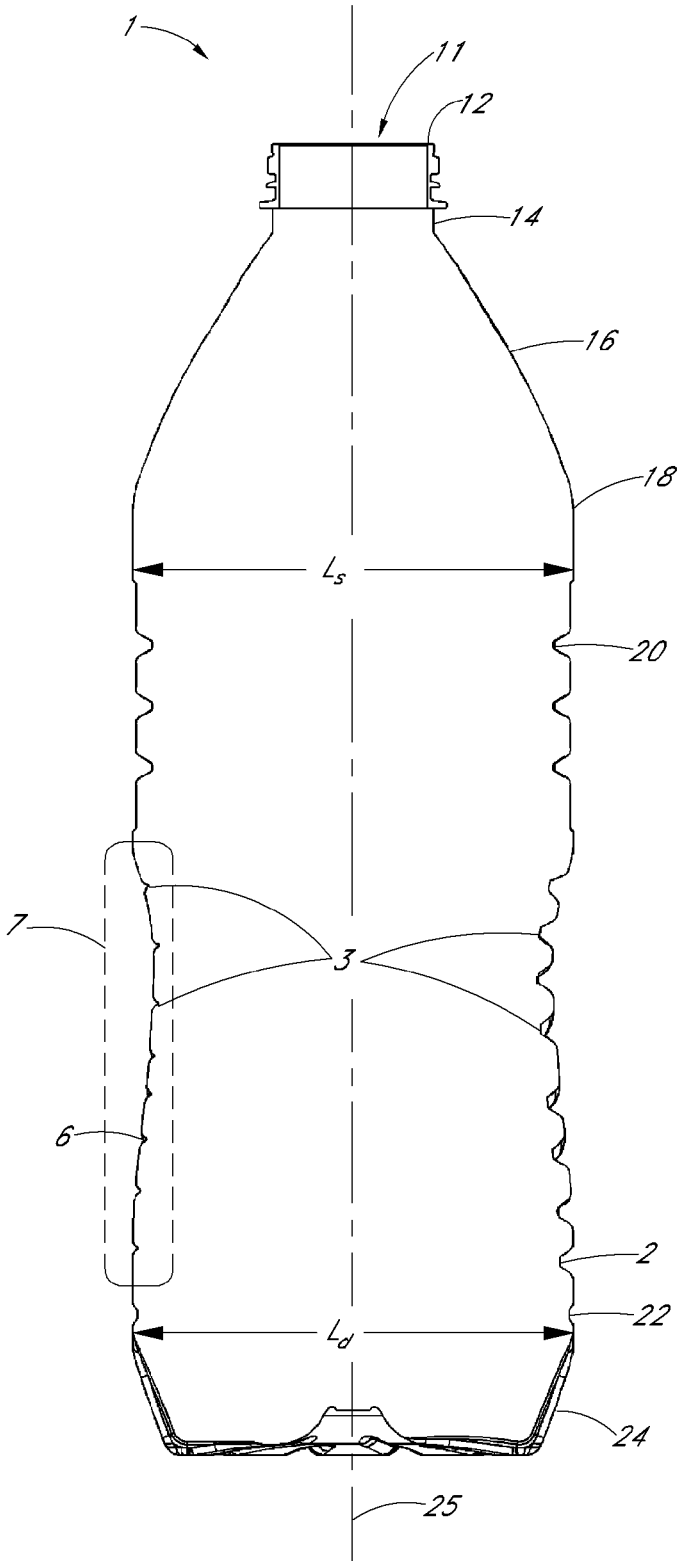
FIG. 10A illustrates an embodiment showing a cross-section of the bottle along a central axis of the bottle.

FIG. 10A illustrates a cross-section along the central axis 25 of an embodiment of the bottle 1. As shown in FIG. 10A, the flat rib or recessed column 7 is located on the opposite side of the bottle circumference of the deep rib 2 portions (with, for example, an embodiment having three recessed columns 7). In the illustrated embodiment, both the label panel ribs 20 and the base ribs 22 have constant cross-sections throughout the circumference of the bottle 1. In some embodiments, the diameter $L_d$ of the base 24 is larger by 0.5 to 2 millimeters, 0.6, 0.7, 0.8, 0.9, 1, 1.1, 1.2, 1.3, 1.4, 1.5, 1.6, 1.7, 1.8, or 1.9 millimeters, including ranges bordered and including the foregoing values, than any other diameter of the bottle 1. In an embodiment with the largest diameter of the bottle 1 being $L_d$, the bottle has a single point of contact at just the base 24 with other substantially similar bottles in a production line and/or packaging. Further, a larger base 24 diameter $L_d$ may improve stability when there is any damage to the base 24. As shown in FIG. 10A, the diameter $L_s$ at the shoulder 18 may be equal to the diameter $L_d$, which provides for two points of contact, at the shoulder 18 and base 24, with other substantially similar bottles in a production line and/or packaging. In some embodiments, the diameter(s) in any portion of the bottle 1 varies, where the largest diameters create points of contact in a production line and/or packaging. The bottles may have either a single point of contact or multiple points of contact.

Figure 10B:
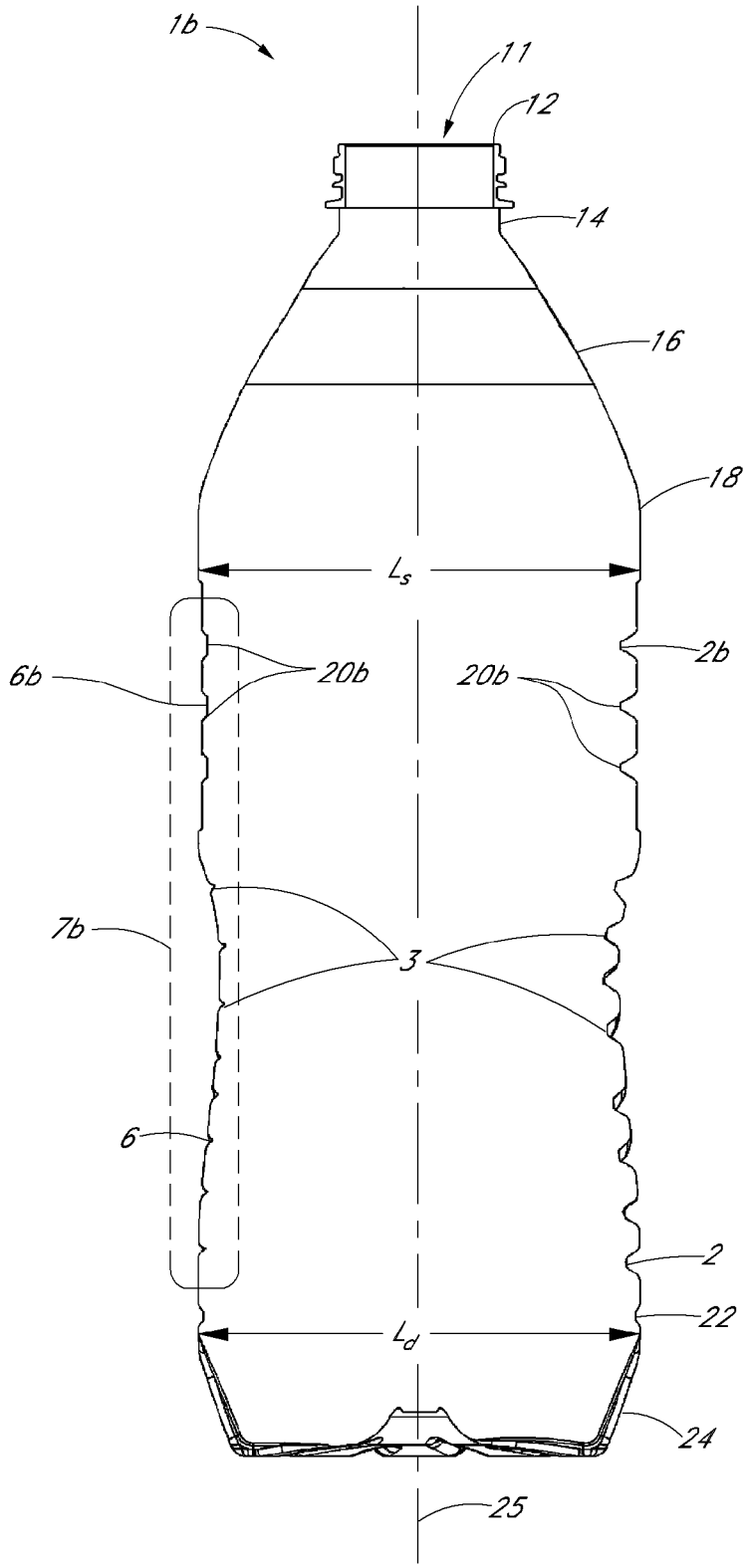
FIG. 10B illustrates an embodiment showing a cross-section of the bottle along a central axis of the bottle.

FIG. 10B illustrates a cross-section along the central axis 25 of an embodiment of the bottle 1*b*. As shown in FIG. 10B, the flat rib or recessed column 7*b* may be located on the opposite side of the bottle circumference of the deep rib 2*b* portions (with, for example, an embodiment having three recessed columns 7*b*). In the illustrated embodiment, the base ribs 22 have constant cross-sections throughout the circumference of the bottle 1*b*. In some embodiments, the diameter $L_d$ of the base 24 is larger by 0.5 to 2 millimeters, 0.6, 0.7, 0.8, 0.9, 1, 1.1, 1.2, 1.3, 1.4, 1.5, 1.6, 1.7, 1.8, or 1.9 millimeters, including ranges bordered and including the foregoing values, than any other diameter of the bottle 1*b* to help achieve features and benefits as discussed herein. As shown in FIG. 10B, the diameter $L_s$ at the shoulder 18 may be equal to the diameter $L_d$, which provides for two points of contact, at the shoulder 18 and base 24, with other substantially similar bottles in a production line and/or packaging. In some embodiments, the diameter(s) in any portion of the bottle 1*b* varies, where the largest diameters create points of contact in a production line and/or packaging. The bottles may have either a single point of contact or multiple points of contact.

Figure 11:
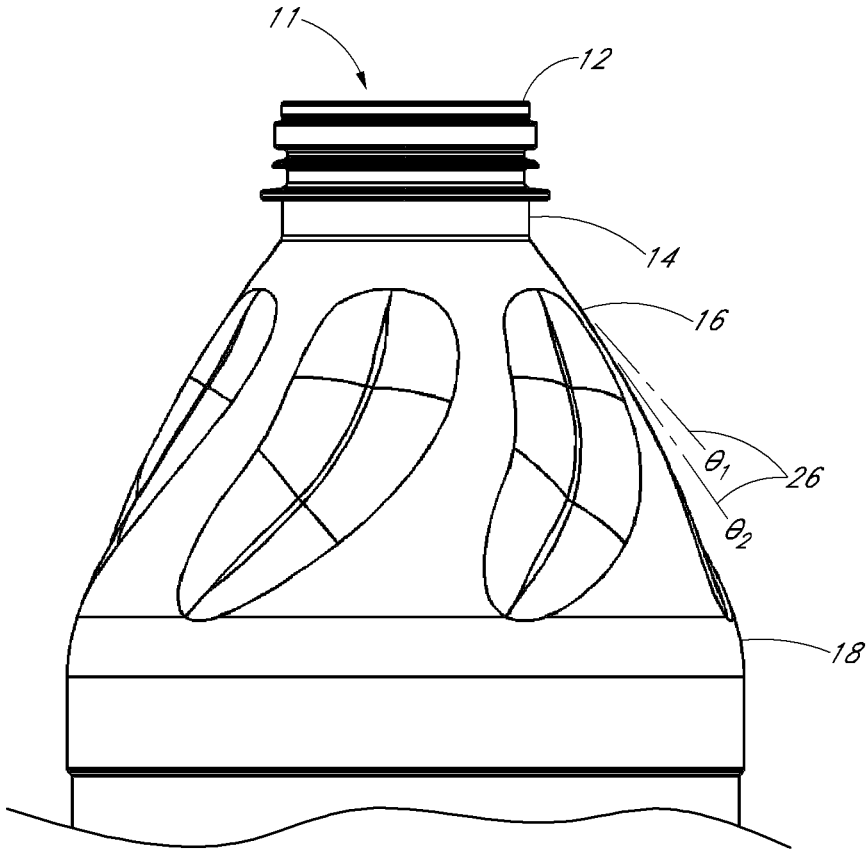
FIG. 11 illustrates an embodiment showing angles of a bell.

Referring to FIGS. 9B and 9C, the bell 16 may have various bell angles 26 as measured from the vertical wall of the finish 12 to the downward sloping wall of the bell 16. The bell angle 26 may be obtuse, varying from 120 to 175 degrees, including 122, 125, 127, 130, 132, 135, 137, 140, 142, 145, 147, 150, 152, 155, 157, 160, 162, 165, 167, 170, or 172 degrees, including ranges bordered and including the foregoing values. Referring to FIG. 11, the bell angle 26 represented by $\theta_2$ is larger than the bell angle 26 represented by $\theta_1$. The wall of bell 16 with $\theta_2$ bell angle 26 is steeper than the wall of bell 16 with $\theta_1$ bell angle 26. A steeper wall of bell 16 can increase the top load capacity of the bottle 1, 1*b* while maintaining the same or even decreasing bell 16 wall thickness.

Figure 12:
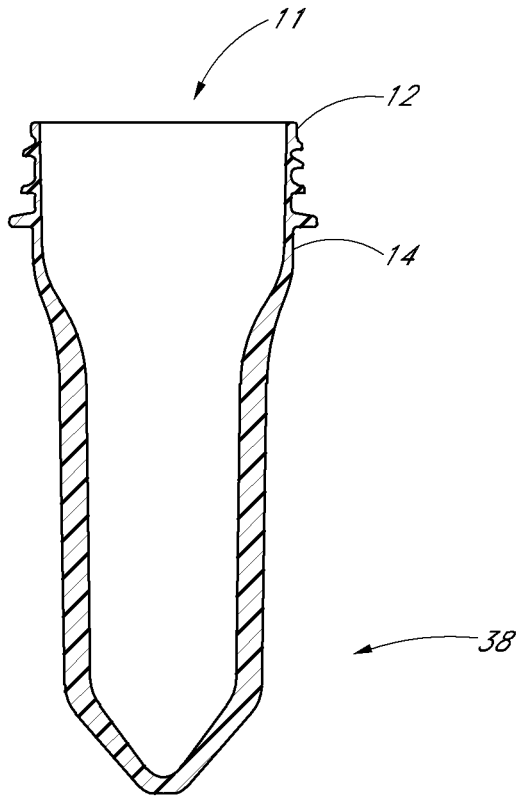
FIG. 12 illustrates a preform of the bottle.

Referring to FIG. 12, an embodiment of the bottle 1, 1*b* may use a preform 38 with a thin wall finish 12 and a thin wall neck 14 to form a lightweight bottle. A thin wall neck 14 improves the ability to blow efficient, lightweight bottles. A thin wall neck 14 is a feature that aids in protecting critical dimensions of the bottle and stabilizing the production blowing process. A thin wall neck 14 can also utilize less resin while achieving the desired mechanical performance resulting in a reduction in the use of petroleum products by the industry. A thin wall neck 14 of preform 38 can aid in forming bottles 1, 1*b* with larger bell angles 26 and/or steeper bell 16 walls as discussed above. As also discussed above, steeper, but relatively thinner, bell 16 walls can support greater top load forces, which can be transferred to the base 24 via the recessed columns 7, 7*b*. Thus, embodiments disclosed herein may incorporate thicker base 24 designs to withstand greater top load forces even when damaged. Achieving a thicker base 24 is aided by a thin wall neck 14 and thin bell 16 walls.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

Although the present invention has been described herein in terms of certain embodiments, and certain exemplary methods, it is to be understood that the scope of the invention is not to be limited thereby. Instead, the Applicant intends that variations on the methods and materials disclosed herein which are apparent to those of skill in the art will fall within the scope of the Applicant's invention.

What is claimed is:

1. A container comprising:

a base;

a grip portion connected to the base through a constant depth base rib and defining a grip portion perimeter that is substantially perpendicular to a central axis;

a label panel portion connected to the grip portion and defining a label portion perimeter that is substantially perpendicular to the central axis;

a bell with an obtuse angle as measured from the central axis to a wall of the bell of at least 120 degrees, the bell connected to the label panel portion through a shoulder and leading upward and radially inward to a finish connected to the bell, the finish adapted to receive a closure;

a plurality of angulating and varying depth ribs positioned substantially along the grip portion perimeter, wherein each angulating and varying depth rib comprises a plurality of shallow sections, a plurality of middle sections, and a plurality of deep sections; and a plurality of constant depth ribs positioned substantially along the label portion perimeter;

wherein the shallow sections have a rib depth less than a rib depth of the middle sections, and the deep sections have a rib depth greater than the rib depth of the middle sections;

wherein the shallow sections of the varying depth ribs substantially vertically line up along the central axis and form recessed columns; and, whereby the recessed columns are configured to resist at least one of bending, leaning, crumbling, or stretching, and the plurality of deep sections are configured to provide hoop strength.

2. The container of claim 1, wherein the varying depth ribs transition from the shallow sections to the middle sections to the deep sections as at least one of a gradual transition or an abrupt transition.

3. The container of claim 1, wherein the varying depth ribs gradually transition from the shallow sections to the middle sections to the deep sections.

4. The container of claim 1, wherein the varying depth ribs have a shape of at least one of trapezoidal, triangular, rounded, squared, oval, or hemispherical.

5. The container of claim 1, wherein the varying depth ribs transition from a trapezoidal shape to a triangular shape along the grip portion perimeter.

6. The container of claim 1, wherein the constant depth ribs angulate around the sidewall perimeter.

7. The container of claim 1, wherein the constant depth ribs have a trapezoidal shape.

8. The container of claim 1, further comprising a rib of a constant depth between at least one of the base and the grip portion, the grip portion and the label portion, or the label portion and the bell.

9. A container comprising:

a base;

a grip portion connected to the base through a constant depth base rib and defining a grip portion perimeter that is substantially perpendicular to a central axis;

a label panel portion connected to the grip portion and defining a label portion perimeter that is substantially perpendicular to the central axis;

a bell with an obtuse angle as measured from the central axis to a wall of the bell of at least 120 degrees, the bell connected to the label panel portion through a shoulder and leading upward and radially inward to a finish connected to the bell, the finish adapted to receive a closure;

a plurality of angulating and varying depth grip ribs positioned substantially along the grip portion perimeter, wherein each angulating and varying depth grip rib comprises a plurality of shallow sections, a plurality of middle sections, and a plurality of deep sections; and a plurality of varying depth label ribs positioned substantially along the label portion perimeter, wherein each varying depth label rib comprises a plurality of shallow sections, a plurality of middle sections, and a plurality of deep sections;

wherein the shallow sections of the angulating and varying depth grip ribs have a rib depth less than a rib depth of the middle sections of the angulating and varying depth grip ribs, and the deep sections of the angulating and varying depth grip ribs have a rib depth greater than the rib depth of the middle sections of the angulating and varying depth grip ribs;

wherein the shallow sections of the varying depth label ribs have a rib depth less than a rib depth of the middle sections of the varying depth label ribs, and the deep sections of the varying depth label ribs have a rib depth greater than the rib depth of the middle sections of the varying depth label ribs;

wherein the shallow sections of the angulating and varying depth grip ribs substantially vertically line up along the central axis and form a first plurality of recessed columns;

wherein the shallow sections of the varying depth label ribs substantially vertically line up along the central axis and form a second plurality of recessed columns; and whereby the first and second pluralities of recessed columns are configured to resist at least one of bending, leaning, crumbling, or stretching, and the pluralities of deep sections of the plurality of angulating and varying depth grip ribs and the plurality of varying depth label ribs are configured to provide hoop strength.

10. The container of claim 9, wherein the first plurality of recessed columns substantially vertically lines up along the central axis with the second plurality of recessed columns.

11. The container of claim 9, wherein the varying depth label ribs of the label panel portion angulate.

12. The container of claim 9, wherein the angulating and varying depth grip ribs transition from the shallow sections to the middle sections to the deep sections as at least one of a gradual transition or an abrupt transition.

13. The container of claim 9, wherein the angulating and varying depth grip ribs gradually transition from the shallow sections to the middle sections to the deep sections.

14. The container of claim 9, wherein the varying depth label ribs transition from the shallow sections to the middle sections to the deep sections as at least one of a gradual transition or an abrupt transition.

15. The container of claim 9, wherein the varying depth label ribs gradually transition from the shallow sections to the middle sections to the deep sections.

16. The container of claim 9, wherein the angulating and varying depth grip ribs have a shape of at least one of trapezoidal, triangular, rounded, squared, oval, or hemispherical.

17. The container of claim 9, wherein the angulating and varying depth grip ribs transition from a trapezoidal shape to a triangular shape along the grip portion perimeter.

18. The container of claim 9, wherein the varying depth label ribs have a shape of at least one of trapezoidal, triangular, rounded, squared, oval, or hemispherical.

19. The container of claim 9, wherein the varying depth label ribs have a trapezoidal shape.

20. The container of claim 9, further comprising a rib of a constant depth between at least one of the base and the grip portion, the grip portion and the label portion, or the label portion and the bell.

* * * * *